US012617644B2

(12) United States Patent
Lombardi et al.

(10) Patent No.: US 12,617,644 B2
(45) Date of Patent: May 5, 2026

(54) SUCTION ROLL OF A WEB, OR SHEET, OF PAPER IN A PAPER CONVERTING MACHINE

(71) Applicant: KÖRBER TISSUE FOLD S.R.L., Porcari (IT)

(72) Inventors: Sergio Lombardi, Viareggio (IT); Daniele Damiani, Coreglia Antelminelli (IT)

(73) Assignee: KÖRBER TISSUE FOLD S.R.L., Porcari (IT)

( * ) Notice: Subject to any disclaimer, the term of this patent is extended or adjusted under 35 U.S.C. 154(b) by 458 days.

(21) Appl. No.: 18/038,016

(22) PCT Filed: Nov. 19, 2021

(86) PCT No.: PCT/IB2021/060736
§ 371 (c)(1),
(2) Date: May 20, 2023

(87) PCT Pub. No.: WO2022/107057
PCT Pub. Date: May 27, 2022

(65) Prior Publication Data

US 2023/0406664 A1 Dec. 21, 2023

(30) Foreign Application Priority Data

Nov. 20, 2020 (IT) ..... 102020000027957

(51) Int. Cl.
*B65H 45/24* (2006.01)
*B65H 20/12* (2006.01)

(52) U.S. Cl.
CPC ..... *B65H 20/12* (2013.01); *B65H 2406/332* (2013.01)

(58) Field of Classification Search
CPC .... B65H 45/24; B65H 29/56; B65H 2511/11; B65H 2511/21; B65H 2220/01;
(Continued)

(56) References Cited

U.S. PATENT DOCUMENTS 3,037,557 A 6/1962 Faeber et al.
4,022,456 A * 5/1977 Hooper ..... A61F 13/15585 493/357
(Continued)

FOREIGN PATENT DOCUMENTS

DE 1474973 A1 9/1969
EP 1 457 444 A2 9/2004
(Continued)

*Primary Examiner* — Leslie A Nicholson, III
(74) *Attorney, Agent, or Firm* — Maschoff Brennan

(57) ABSTRACT

A suction roll of a web, or sheet, of paper, includes a tubular body that rotates about a longitudinal rotation axis. External and internal lateral surfaces of the suction roll pneumatically communicate with each other through suction holes. The roll includes a suction chamber pneumatically connected to a vacuum generation device for generating a predetermined vacuum degree. A vacuum distribution device selectively puts into pneumatic communication the suction chamber with at least one row of suction holes, at determined angular positions of the tubular body and causes the processed sheet or web of paper to be sucked, and to adhere at a corresponding portion of the external lateral surface arranged between a catching point and a releasing point having determined angular positions. A displacement device moves the vacuum distribution device to change the angular position of the catching or releasing point of the web or sheet of paper.

17 Claims, 13 Drawing Sheets

(58) Field of Classification Search
CPC ..... B65H 2220/02; B65H 2220/11; B65H 2513/11; B65H 2515/112; B65H 2406/33; B65H 2406/361; B65H 2406/332; B65H 20/12
USPC ..... 270/39.05
See application file for complete search history.

(56) References Cited

U.S. PATENT DOCUMENTS

| | | | | |
|---|---|---|---|---|
| 6,024,685 | A | 2/2000 | Kirsch | |
| 6,585,139 | B1 | 7/2003 | Holtmann et al. | |
| 11,034,541 | B2 * | 6/2021 | Mencarini | B65H 45/28 |
| 11,230,453 | B2 * | 1/2022 | De Matteis | B65H 27/00 |
| 2004/0159999 | A1 * | 8/2004 | Dematteis | B65H 45/24 271/264 |
| 2014/0353123 | A1 * | 12/2014 | Schoultz | B65H 45/16 198/689.1 |
| 2019/0270609 | A1 * | 9/2019 | Mencarini | B65H 45/28 |

FOREIGN PATENT DOCUMENTS

| | | | |
|---|---|---|---|
| IT | 20080167 | A1 | 9/2009 |
| WO | 91/19613 | A1 | 12/1991 |
| WO | 2010/140046 | A1 | 12/2010 |
| WO | 2012/080859 | A2 | 6/2012 |
| WO | 2018/019679 | A1 | 2/2018 |
| WO | 2019/149905 | A1 | 8/2019 |

* cited by examiner

Fig. 18
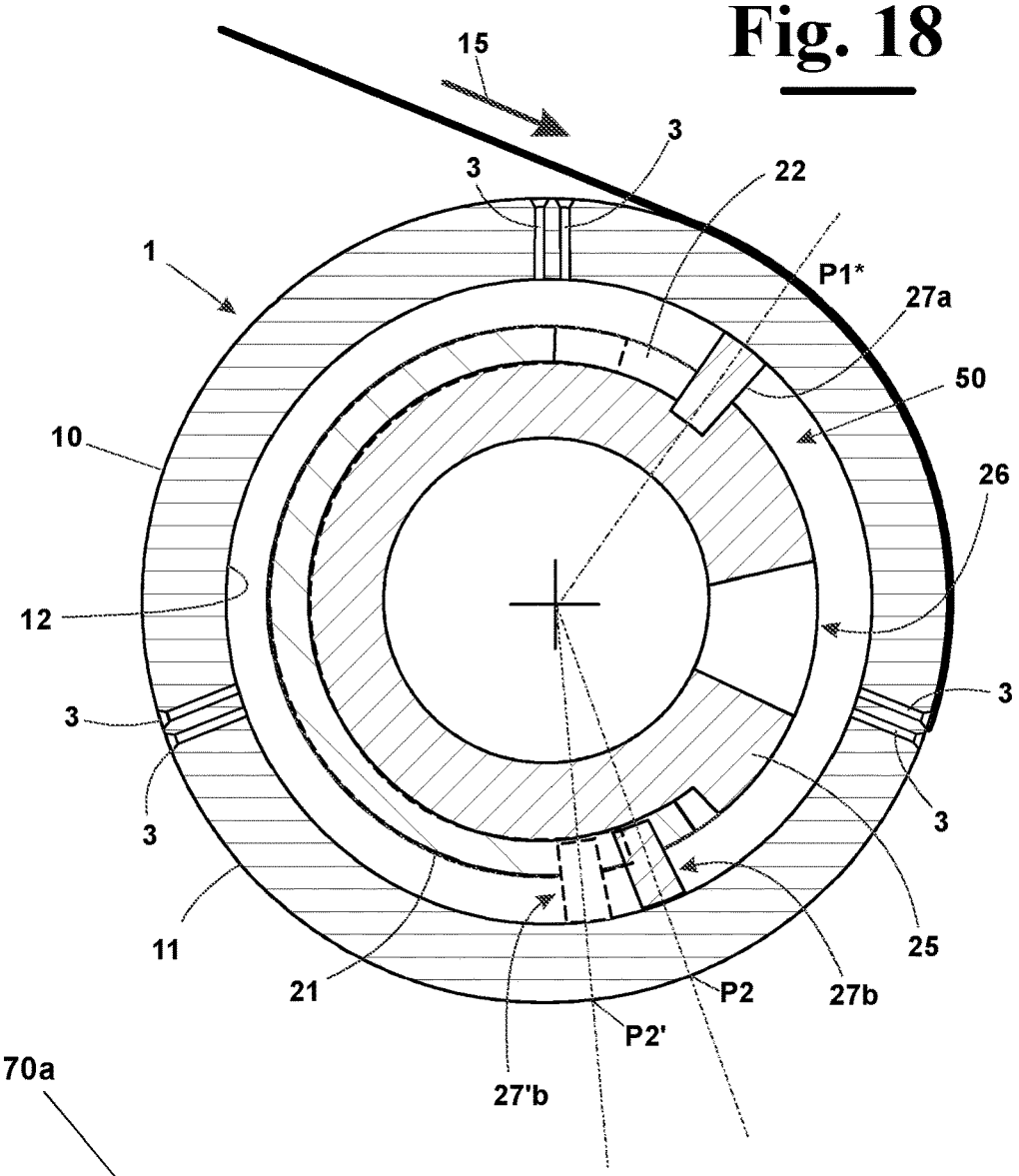
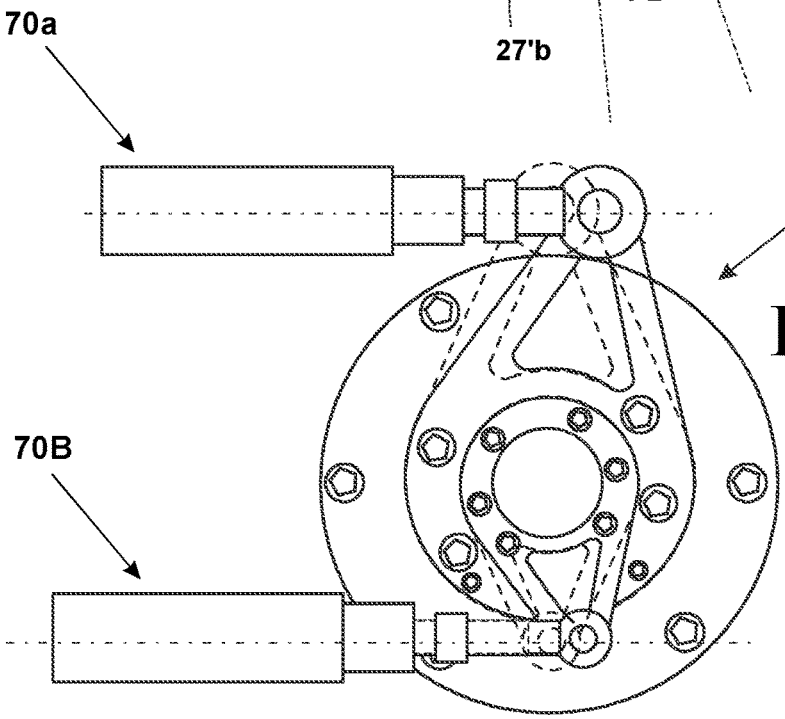
Fig. 19

SUCTION ROLL OF A WEB, OR SHEET, OF PAPER IN A PAPER CONVERTING MACHINE

FIELD OF THE INVENTION

The present invention relates to the technical field of paper converting, and similar products, and, in particular, it relates to a machine for interfolding a web, or sheet, of paper, equipped with at least one suction roll, in particular a cut roll, or a folding or interfolding roll, provided with suction holes which are connected to a vacuum system to cause the sheet, or web, of paper to adhere on its surface.

DESCRIPTION OF THE PRIOR ART

As it is known, many machines are used in the paper industry, for example winding and interfolding machines, which are equipped with systems for causing the processed web, or sheet of paper, to adhere on the surface of the rolls, in determined working steps, in such a way to guide the sheets or webs of paper along a desired path through the machine.

In particular, these systems are used to carry out the very important operations of cutting the paper, or transferring very quickly the paper same from a roll to another one, or also to provide the final fold of the paper in order to obtain a folded or interfolded product.

The systems which cause the aforementioned adhesion can provide mechanical pliers, or pneumatic suction systems.

In the case of pneumatic systems, a device for generating a determined vacuum degree, normally a vacuum pump, is provided that is pneumatically connected to the inner part of the suction roll. More precisely, the surface of the suction roll provides a determined number of rows of suction holes distributed on the surface of the roll in such a way to cause the processed web or sheet to adhere only at determined portions. Normally, a suction roll provides 3, or 4, couples of rows of suction holes close to each other positioned at 120°, or 90°, one with respect to the other, and pneumatically connected with the vacuum generation device at determined angular positions of the suction roll, in such a way to cause the processed web or sheet of paper to adhere at a determined portions of the surface of the suction roll.

A known type of suction rolls is, for example, described in EP1457444. In particular, the suction roll of EP1457444, that can be an advancement roll, or a folding roll, comprises a tubular body provided with the aforementioned plurality of rows of holes, for example 4 couples of rows of holes arranged at 90° with respect to each other and configured to rotate during working conditions about a longitudinal axis. The suction roll is, furthermore, provided with a second tubular body coaxially mounted within the aforementioned tubular body. In particular, the inner tubular body is pneumatically connected to a device for generating a determined vacuum degree and two sealing members are, furthermore, provided that extend longitudinally between the aforementioned tubular bodies at opposite sides with respect to the, or each aperture. In this way, the inner tubular body, the internal surface of the outer tubular body and the two longitudinal sealing members, define a suction chamber at a determined position of the suction roll. Therefore, the web or sheet of paper is sucked by the suction chamber at a first point P1 having a first predetermined angular position, at which a longitudinal row of suction holes is positioned by the rotation of the outer tubular body at the aforementioned suction chamber, or, more precisely, immediately downstream of the sealing member. The web or sheet of paper is, then, released at a second point P2, having a second predetermined angular position, at which the aforementioned longitudinal row of suction holes is positioned by the rotation of the outer tubular body at a position external to the aforementioned suction chamber, or, more precisely, immediately downstream of the second sealing member. Therefore, the web or sheet of paper is held on the portion of the suction roll surface arranged between the first and second points P1 and P2 to carry out the aforementioned cut, or fold, or advancement operation along the machine.

However, the solution described in EP1457444, as well as other analogous prior art solutions, have some drawbacks.

In particular, the advancement speed of the processed web or sheet of paper along the machine in which the suction roll described in EP1457444 is installed, as well as other analogous suction rolls, cannot overcome a predetermined threshold value, normally about 150-200 m/min, value that is imposed by constructional and functional limits of determined machine components.

The aforementioned values of the advancement speed of paper along the machine are also used, together with the path to be followed, to design the suction roll, in particular for positioning the sealing members at predetermined angular positions. If, instead, the aforementioned speed values used to design the suction roll are not observed during the functioning of the machine, it is possible to have problems of different kind. In particular, if the aforementioned threshold values are exceeded, due to the inertia of paper, the processed web or sheet, remains adhered to the surface of the suction roll even after the second angular position, i.e. at a portion of the surface positioned downstream of the second sealing member. This causes the web or sheet of paper to imprecisely move through the different sections of the machine and, in addition to unavoidably compromise the quality of the final product, in particular forming unwanted folds, can also cause the paper to be jammed and the need to stop the machine to remove the jammed paper thus losing time and productivity.

For example, in the case that the suction rolls described in EP1457444 are used as folding rolls to obtain an interfolded product, exceeding the determined speeds, the stack of interfolded sheets is inaccurately formed and, in some cases, the machine can block.

Therefore, in order to avoid the aforementioned functional drawbacks and loss of quality of the final product, it is necessary to operate at predetermined speeds beyond which it is not possible to work.

Analogous drawbacks in the prior art machines, also in the case that a web or sheet of paper is to be processed having a paper weight different from the paper weight on the basis of which the aforementioned suction roll is designed. In fact, due to the higher inertia that a paper with a higher paper weight shows with respect to a paper having a smaller paper weight, if a web or sheet of paper with a paper weight higher than a predetermined paper weight is processed, the processed web or sheet of paper remains adhered to the suction roll beyond the predetermined releasing point P2*, and, in general, cover a distance higher than that caused by the suction of the roll, thus causing the aforementioned functional drawbacks and of loss of quality of the product. Therefore, the prior art machines provided with suction rolls are rigid because they have to accept arrangements of quality to work webs, or sheets of paper with different paper weights.

SUMMARY OF THE INVENTION

It is, therefore, an object of the present invention to provide a suction roll, in particular a cutting roll, or a folding or interfolding roll, that is able to overcome the aforementioned drawbacks of the suction rolls of prior art.

It is, in particular, object of the present invention to provide a suction roll, which is able to prevent wrinkles, or "creases", on the processed sheets and, therefore, to guarantee the obtainment of a final product of excellent quality independently from the advancement speed of the web and in particular with advancement speeds higher than the threshold limits above disclosed.

It is also an object of the present invention to provide a folding or interfolding unit equipped with a couple of this kind of suction rolls able to carry out the folding or the interfolding of the web or sheet of paper at high speed without compromising the quality of the final product.

It is another object of the present invention to provide a method for sucking a web or sheet of paper in a paper converting machine having the aforementioned advantages with respect to the prior art methods.

These and other objects are achieved by a folding or interfolding roll, according to the invention, of a web, or sheet, of paper, fed along an advancing direction in a paper converting machine, or similar products, said suction roll comprising:

- a tubular body configured to rotate about a longitudinal rotation axis in a predetermined sense of rotation, said tubular body being provided with an external lateral surface and an internal lateral surface pneumatically communicating with each other through a plurality of suction holes organized according to plurality of longitudinal rows;
- a suction chamber defined within said suction roll and pneumatically connected to a vacuum generation device configured to generate a predetermined vacuum degree;
- a vacuum distribution device configured to selectively put into pneumatic communication said suction chamber with at least one row of suction holes of said plurality at determined angular positions of said tubular body, and to cause the processed sheet or web of paper to be sucked, and to adhere at a corresponding portion of said external lateral surface of said suction roll arranged between a catching point and a releasing point (P1,P2) having determined angular positions;

whose main characteristic is that a displacement device is, furthermore, provided configured to move said vacuum distribution device, in such a way to change the angular position of said catching point (P1) and/or said releasing point (P2) of said web or sheet of paper, and therefore, to anticipate, or postpone, the catching instant (ta) and/or the releasing instant (tr) in which said web or sheet of paper adheres to or leaves said external lateral surface of said suction roll.

Other technical characteristics of the present invention are defined in the dependent claims.

According to another aspect of the invention, a method for feeding a web or sheet of paper in a paper converting machine comprising the steps of:

- suction of a web or sheet of paper, or similar products, on an external lateral surface of a suction roll comprising:
  - a tubular body configured to rotate about a longitudinal rotation axis in a predetermined sense of rotation, said tubular body being provided with said external lateral surface and with an internal lateral surface pneumatically communicating with each other through a plurality of suction holes organized according to a plurality of longitudinal rows;
  - a suction chamber defined within said suction roll and pneumatically connected to a vacuum generation device configured to generate a predetermined vacuum degree;
  - a vacuum distribution device configured to selectively put into pneumatic communication said suction chamber with at least one row of suction holes of said plurality at determined angular positions of said tubular body, and to cause the processed sheet or web of paper to be sucked, and to adhere at a corresponding portion of said external lateral surface of said suction roll arranged between a catching point and a releasing point (P1,P2) having determined angular positions;

and wherein a displacing step is, furthermore, provided to move said vacuum distribution device, in such a way to change the angular position of said catching point (P1) and/or said releasing point (P2) of said web or sheet of paper, and therefore, to anticipate or postpone, the catching instant (ta) or the releasing instant (tr) in which said web or sheet of paper adheres to, or leaves, said external lateral surface of said suction roll.

BRIEF DESCRIPTION OF THE DRAWINGS

The invention will now be shown with the following description of its exemplary embodiments, exemplifying but not limitative, with reference to the attached drawings in which:

FIGS. 16 and 18 show transverse cross section views of other possible alternative embodiments of the suction roll according to the invention;

FIG. 19 shows a side elevation view of another alternative embodiment according to the invention for the suction roll of FIG. 18;

FIGS. from 20 to 22 diagrammatically show side elevation views of some possible embodiments of paper converting machines provided with the suction roll, according to the invention.

DETAILED DESCRIPTION OF SOME EXEMPLARY EMBODIMENTS OF THE INVENTION

Figure 1:
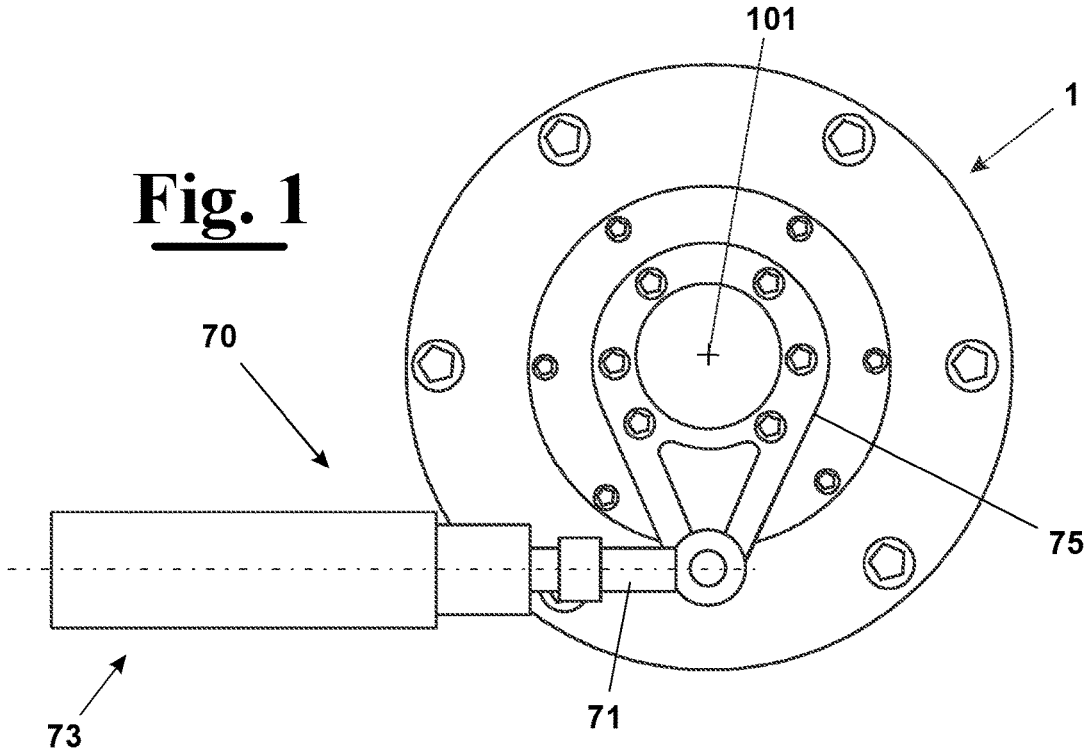
FIG. 1 diagrammatically shows a side elevation view of a first embodiment of a suction roll according to the invention.
Figure 2:
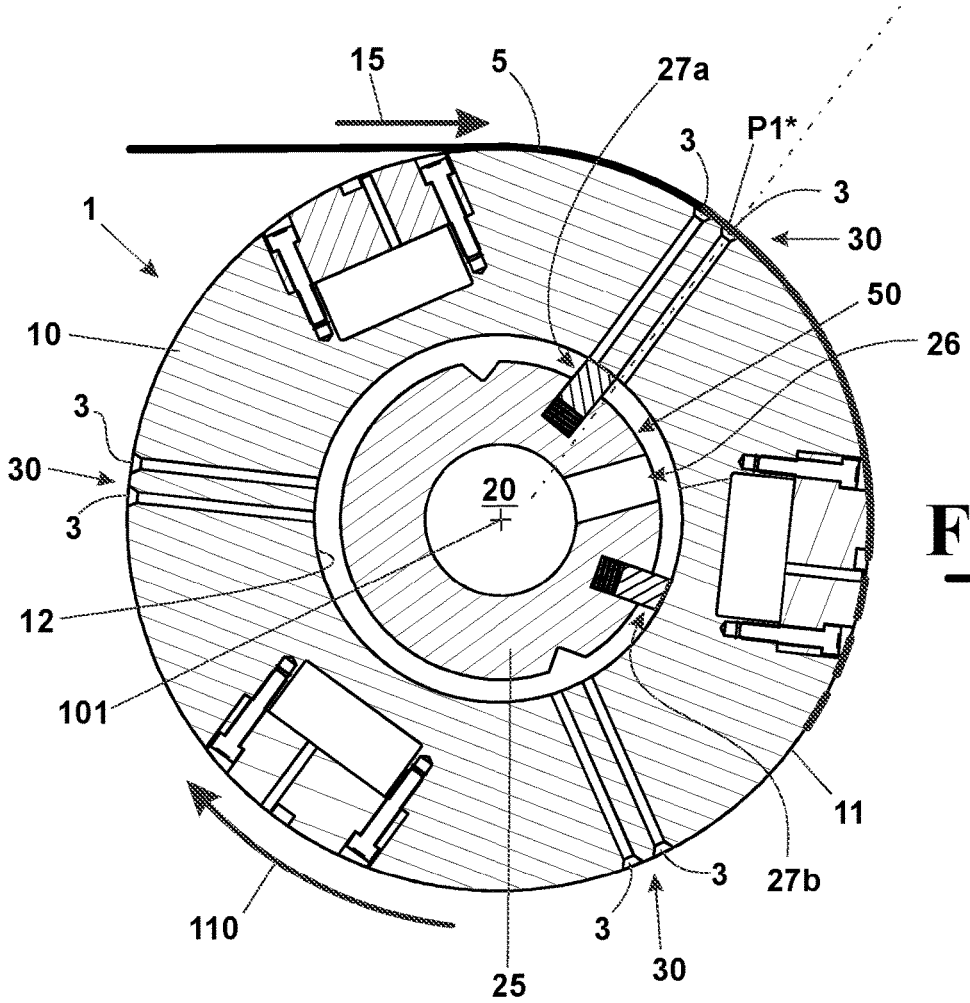
FIGS. 2 and 3 diagrammatically show transversal cross section views of a first embodiment of a suction roll, according to the invention, respectively in the instant of catching, and in the instant of releasing a web or sheet of paper.
Figure 3:
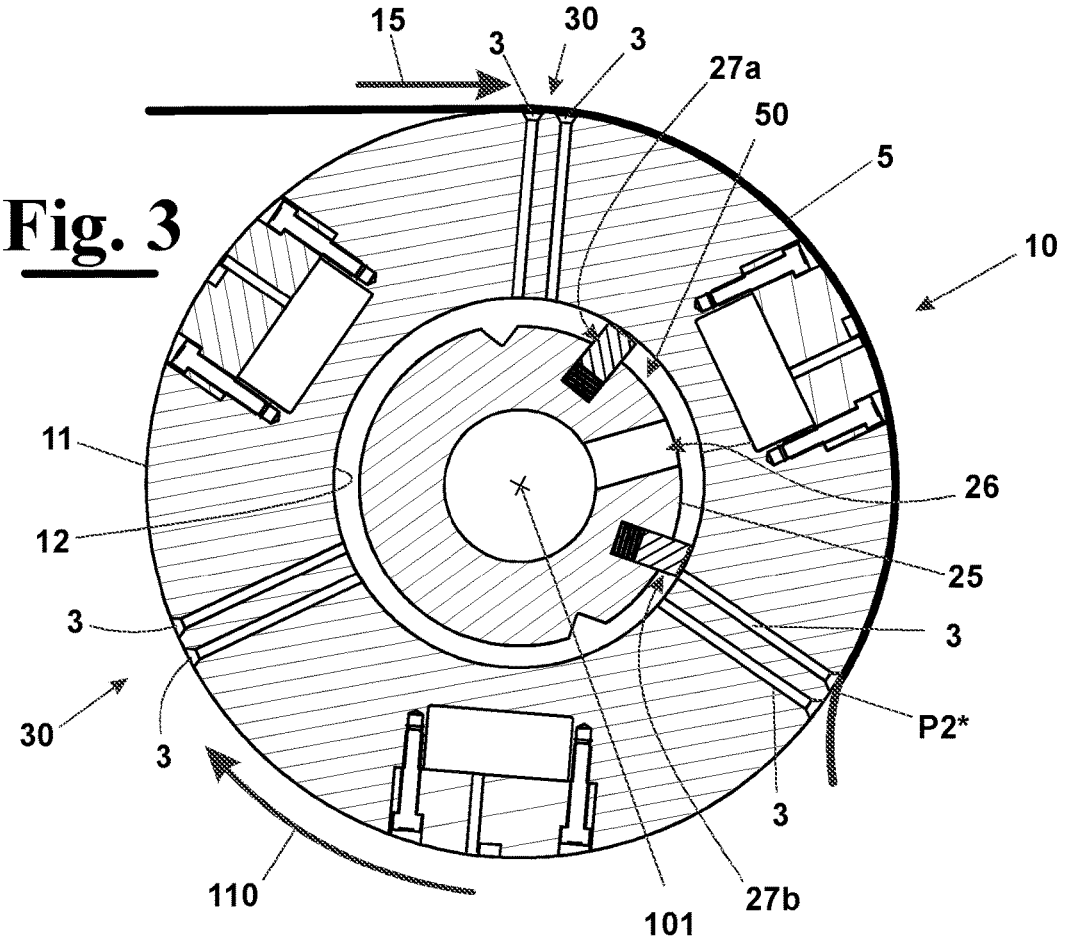

As diagrammatically shown in the FIGS. from 1 to 3, a suction roll 1 of a web, or sheet, of paper 5 fed along an advancing direction 15 in a paper converting machine, or similar products, comprises a tubular body 10 configured to rotate in a predetermined sense of rotation 110, for example clockwise, about a longitudinal rotation axis 101, as in the case of FIG. 2. More precisely, the tubular body 10 of roll 1 is provided with an external lateral surface 11 and with an internal lateral surface 12 communicating with each other through a plurality of suction holes 3.

In particular, the suction holes 3 of the suction roll 1 can be organized according to a plurality of suction groups 30, for example 2, or 3, or 4, suction groups 30, arranged at predetermined angular positions of the suction roll 1, for example at 180°, 120°, or 90° one with respect to the other. Generally, the angular position of the suction groups 30 depends on the number of sheets 5 which can be arranged adjacent on the external lateral surface 11 of suction roll 1. The circular arc comprised between a suction group 30 and the following one is equal to the length of a processed sheet 5. Therefore, in function of the diameter of the suction roll 1 it is possible to have 2, 3, 4 or even more suction groups 30. For example, if on suction roll 1, five suction groups 30 are present, the angular distance between the suction groups 30 will be 72°. In the examples described below, the suction roll 1 provides 3 suction groups 30 each of which comprising 2 longitudinal rows of suction holes 3 close to each other. The suction roll 1 provides, furthermore, a suction chamber 20 arranged within the aforementioned tubular body 10, and pneumatically connected to a device for generating a predetermined vacuum degree, in particular a suction device, for example a vacuum pump, not shown in the figures for simplicity, but however of known type to a skilled person in the art. It is, furthermore, provided a vacuum distribution device 50 configured to selectively put into pneumatic communication the suction chamber 20 with at least one row of suction holes 3 of the aforementioned plurality, at predetermined angular positions of the tubular body 10. In this way, as known, the processed sheet or web of paper is caused to be sucked and to adhere only at a determined portion of the external lateral surface 11 of the suction roll 1 comprised between a catching point P1 and a releasing point P2 having determined angular positions, in particular with respect to a predetermined reference system (Xo, Yo,Zo). According to the invention, a displacement device 70 is provided configured to move the aforementioned vacuum distribution device 50, in such a way to change the angular position at least of the releasing point P2, in particular with respect to a predetermined angular position P2* which this occupies with respect to the aforementioned predetermined reference system (Xo, Yo,Zo). The displacement device 70 is operated by a main control unit, for example a PLC, an industrial PC, or equivalent control units, not shown in the figures for simplicity. The main control unit can be interfaced with an operator by an interface panel, or HMI "Human Machine Interface", through which an operator can command and/or adjust the machine 100.

In this way, it is possible to anticipate or postpone, the instant ta in which the web or sheet of paper adheres to the aforementioned external lateral surface 11 of the suction roll 1, and/or the instant tr in which the web or sheet of paper 5 leaves the aforementioned external lateral surface 11 of the suction roll 1.

In particular, the aforementioned displacement device 70 can be configured to move the aforementioned vacuum distribution device 50 as a function of at least one predetermined working parameter of the machine 100 within which the suction roll 1 is installed. For example, the aforementioned predetermined working parameter can be the advancement speed of the web or sheet of paper along the machine 100.

Figure 4:
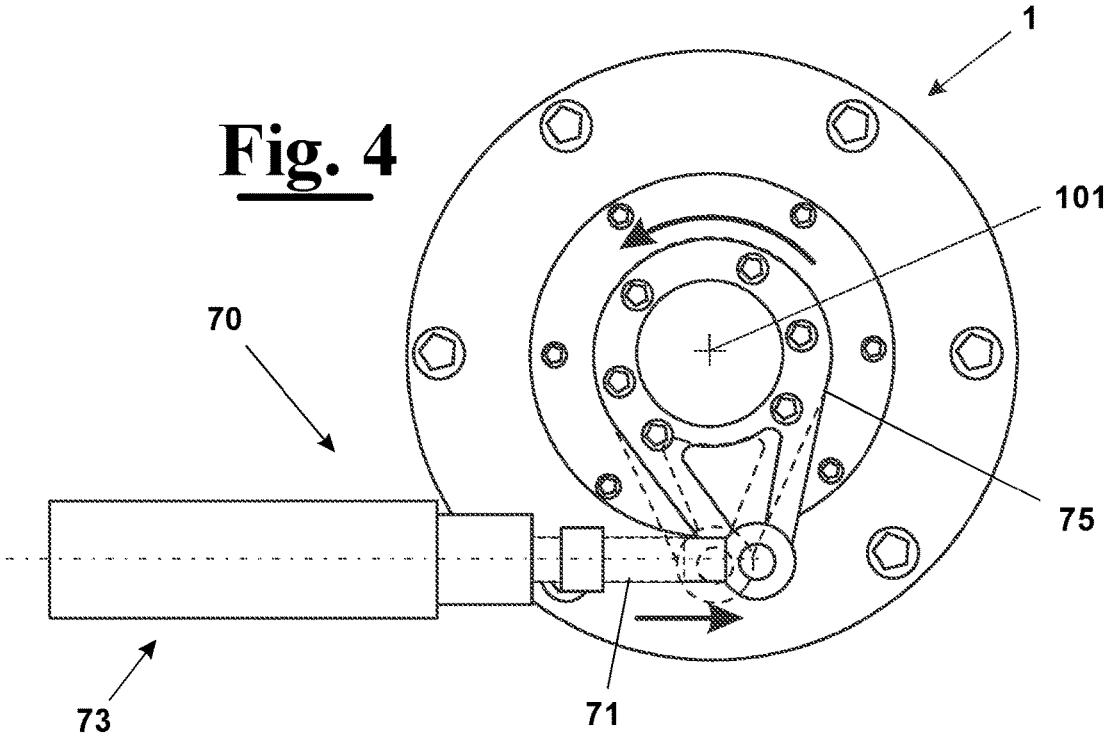
FIGS. 4 and 5 diagrammatically show, respectively, a side elevation view and a transversal cross section of a first functioning mode of the suction roll according to the invention.
Figure 5:
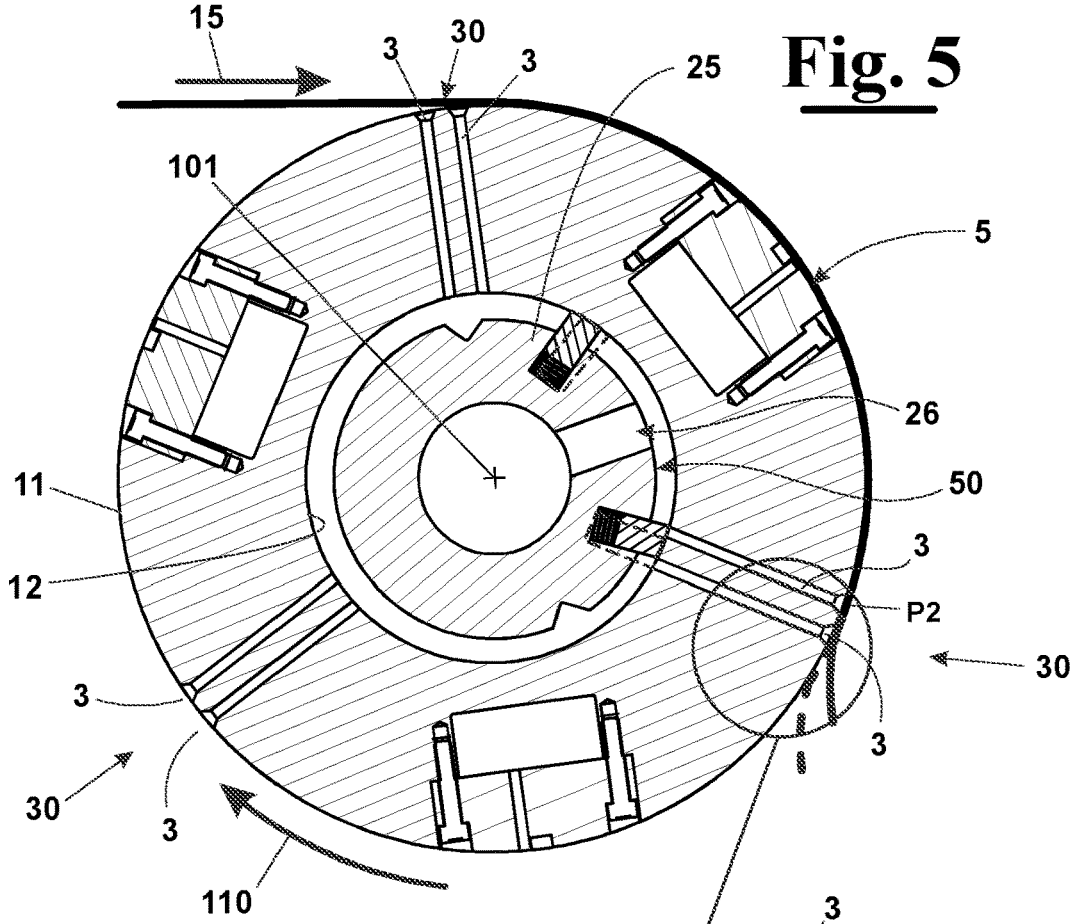
Figure 6:
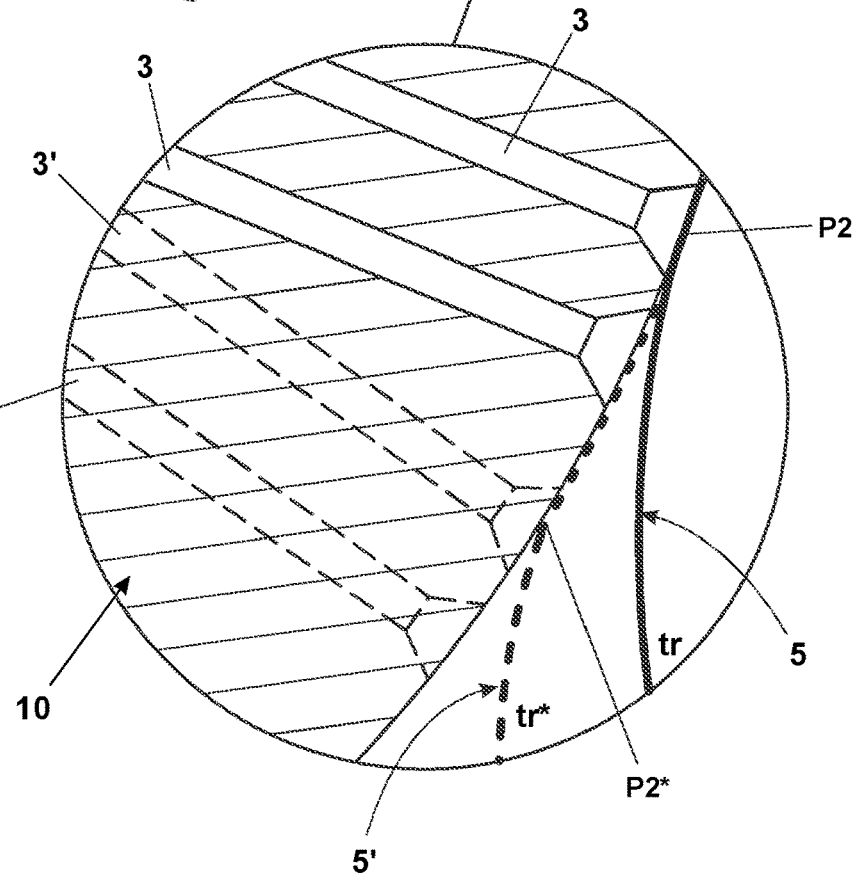
FIG. 6 shows an enlargement of a portion of FIG. 5 to diagrammatically show some aspects of the first functioning mode of the suction roll according to the invention.

In this case, in particular, if the advancement speed v of the web or sheet of paper is greater than a predetermined reference value v*, the displacement device 70 will be arranged to move the vacuum distribution device 50 in such a way to anticipate the instant tr in which the web or sheet of paper is released from the suction roll 1. In particular, the displacement device 70 can be configured, in this case, in such a way to rotate the aforementioned vacuum distribution device 50 in the sense opposite to the aforementioned sense of rotation 110 of the suction roll 1 about the rotation axis 101 (FIGS. 4 to 6).

Figure 7:
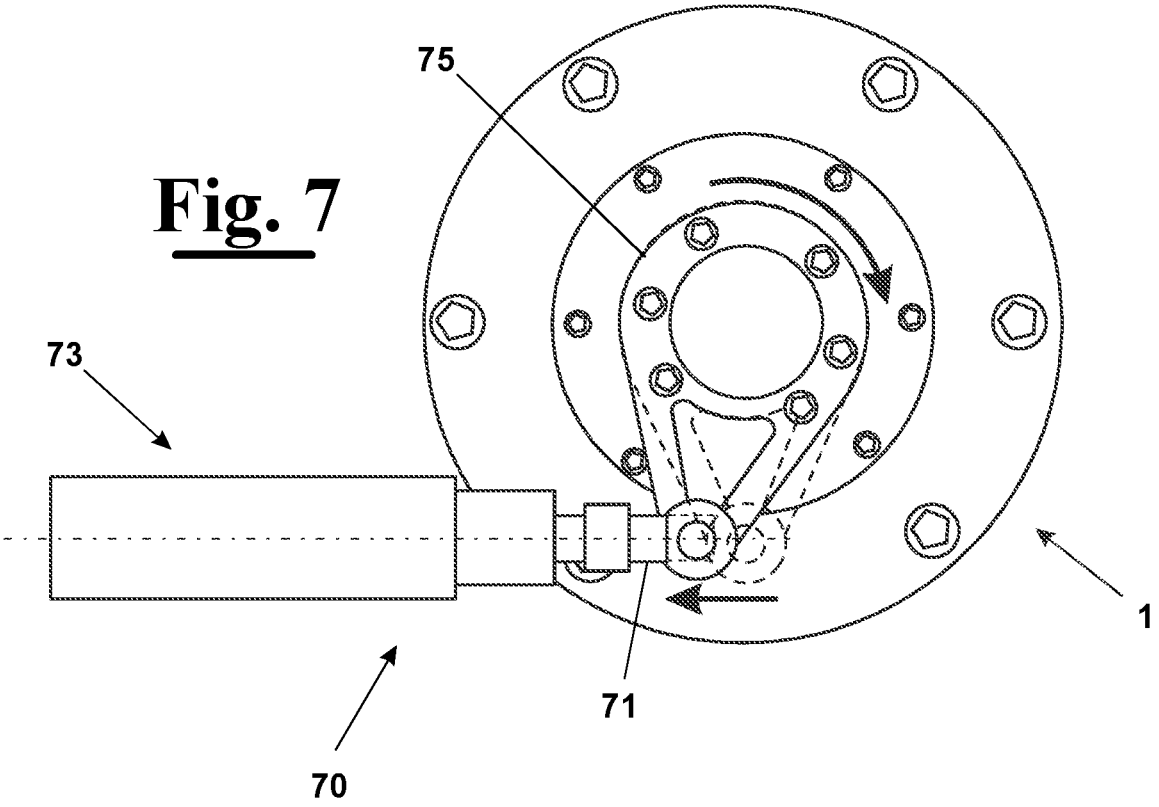
FIGS. 7 and 8 diagrammatically show, respectively, a side elevation view and a transversal cross section of a second functioning mode of the suction roll according to the invention.
Figure 8:
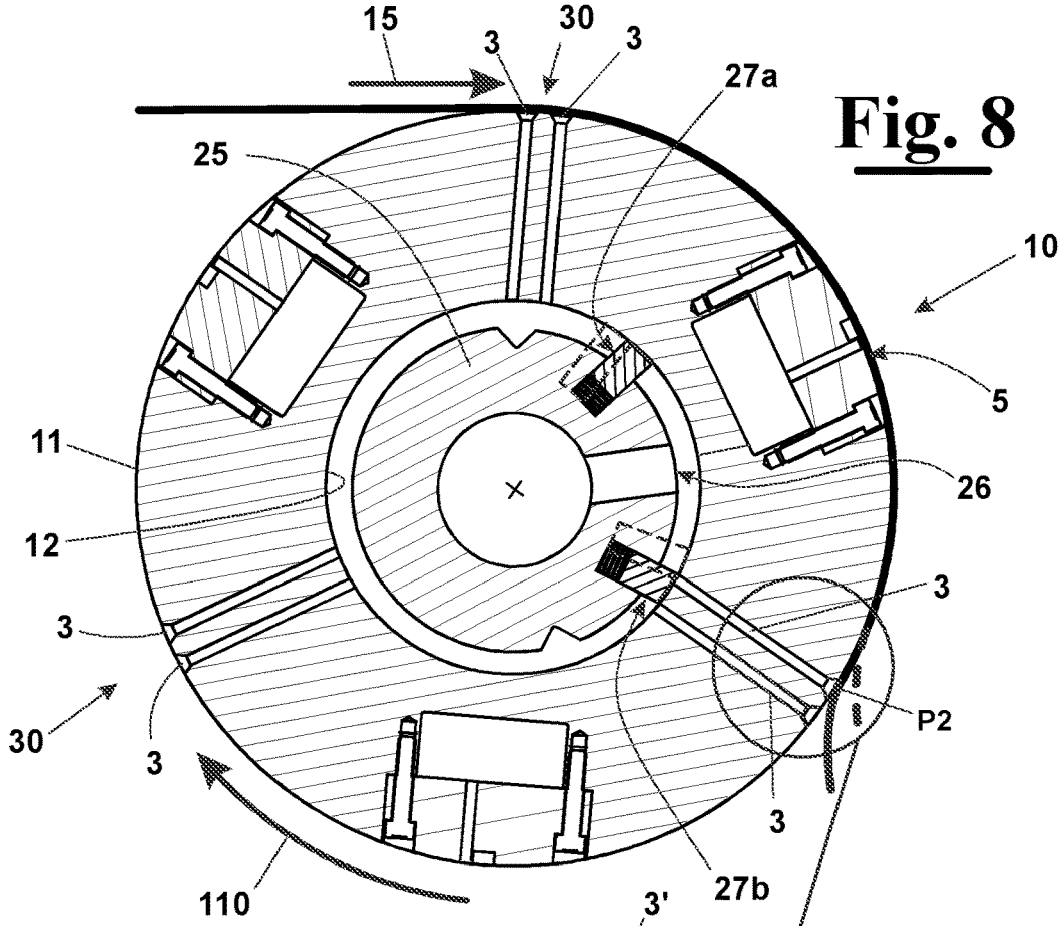
Figure 9:
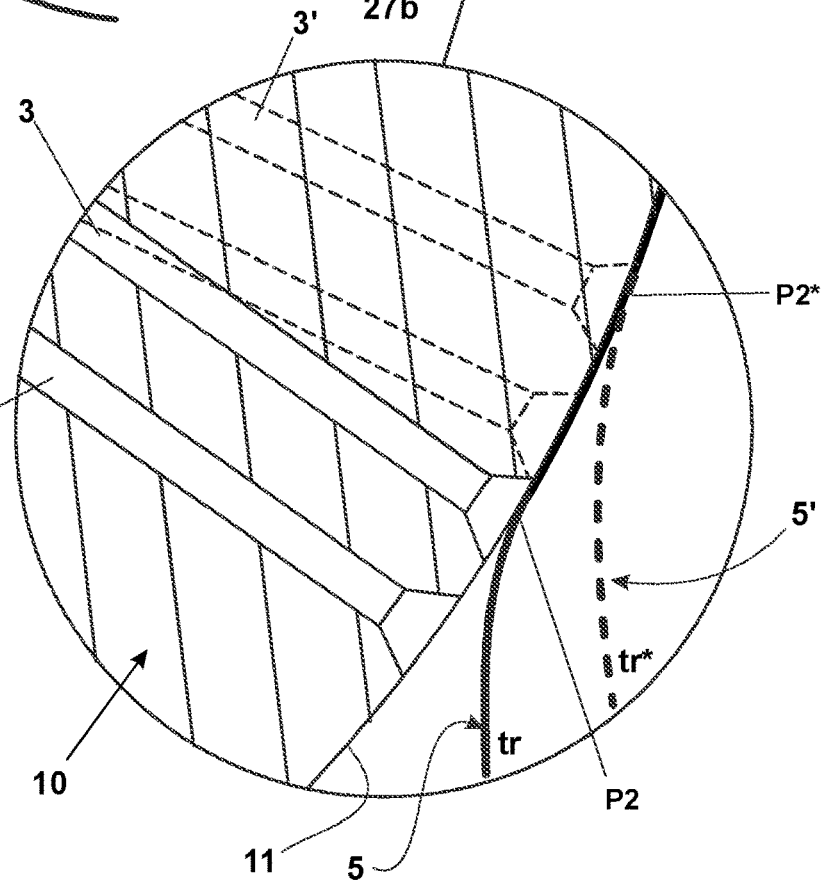
FIG. 9 shows an enlargement of a portion of FIG. 8 to diagrammatically show some aspects of the second functioning mode of the suction roll according to the invention.

Instead, if the machine 100 is operated at a slower advancement speed of the paper with respect to the aforementioned reference value v*, the displacement device 70 is arranged to move the aforementioned vacuum distribution device 50 in such a way to postpone the detaching of the web or sheet of paper with respect to a reference condition. More precisely, the displacement device 70 will be, in this case, arranged to rotate the aforementioned vacuum distribution device 50 in the same sense of the aforementioned sense of rotation 110 of the suction roll 1 about the rotation axis 101 (FIGS. 7 to 9).

In a preferred configuration of the invention, it is possible to rotate the vacuum distribution device 50 as a function of at least one working parameter, for example the advancement speed of the paper. In this case, the main control unit operates the displacement device 70 to cause the appropriate rotation of the vacuum distribution device 50. The main control unit can operate the displacement device 70 according to a predetermined function or on the basis of algorithms computed in real time, for example self-learning algorithms or, in general, artificial intelligence algorithms.

In an alternative embodiment of the invention, it is possible to control the position of the catching point P1 and/or the detaching point P2 alternating the angular position of the vacuum distribution device 50 between at least two predetermined positions. For example, the position P1 can correspond to the slow advancement speed of the paper, whilst the position P2 can correspond to a high speed of the paper. In this case, a threshold of the speed can be set beyond which the displacement device 70 is operated to move the vacuum distribution device 50 from position P1 to position P2 anticipating or postponing, the detachment of the web or sheet of paper, 5. The operation command of the displacement device 70 can be given directly by the main control unit 300, or by an operator, through an interface device, for example of HMI (Human Machine Interface) type. Another working parameter of the machine 100 in function of which the displacement device 70 can be arranged to move the vacuum distribution device 50 can be the thickness s, or in general the paper weight of the processed web or sheet. In particular, if the thickness of the paper is greater than a predetermined reference thickness s*, the displacement device 70 can be arranged to move the vacuum distribution device 50 in such a way to anticipate the instant tr in which the web or sheet of paper 5 is released from roll 1, in particular with respect to a releasing reference instant tr*.

In particular, in this case, the displacement device 70 can be arranged to rotate the vacuum distribution device 50 in the sense opposite to the sense of rotation 110 of the tubular body 10 about the longitudinal axis 101. Instead, in the case that the thickness paper is smaller than the predetermined reference thickness s*, the displacement device 70 is arranged to move the vacuum distribution device 50, in such a way to postpone the instant in which the web or sheet of paper is released from roll 1. In particular, in this case, the displacement device 70 can be arranged to rotate the vacuum distribution device 50 in a sense of rotation consistent with the sense of rotation of the tubular body 10 about the longitudinal axis 101.

In this case, it is possible to adjust the machine 100 in function of the product i.e. in function of the characteristics of the paper which has to be processed. The displacement device 70 can be operated in a different way in function of the type of paper or product to be processed thus obtaining great advantages in terms of setting times of the machine 100 during a product change. Each product or type of paper can correspond to specific movements of the displacement device 70 or to a specific reference value of the paper speed v* optimizing the catching point P1 and the releasing point P2 for a specific product, or paper.

In a preferred embodiment of the invention, the aforementioned displacement device 70 can be configured to move, in particular to rotate, the vacuum distribution device 50, in particular to postpone, or anticipate, the instant tr in which the web or sheet of paper is caused to be detached from the surface 11, during working conditions of the machine 100, which means during the rotation of the tubular body 10 about the aforementioned longitudinal rotation axis 101. In this way, in particular, it is possible to move the vacuum distribution device 50, in such a way to progressively follow the increase or the decrease of the advancement speed of the web or sheet of paper.

In particular, in a first embodiment, the aforementioned vacuum distribution device 50 can comprise a fixed tubular body 25 coaxially mounted within of the aforementioned tubular body 10. More in particular, the aforementioned fixed tubular body 25 is pneumatically connected to the device for generating a predetermined vacuum degree and at least one aperture 26 is provided. More precisely, the vacuum distribution device 50 can comprise, furthermore, a first and a second sealing member 27*a*, and 27*b* integral to the fixed tubular body 25 at opposite sides with respect to the, or each, aperture 26 and positioned longitudinally to tubular body 10. In particular, the displacement device 70 can be configured to cause a rotation of the fixed tubular body 25 about the aforementioned longitudinal rotation axis 101.

Figure 10:
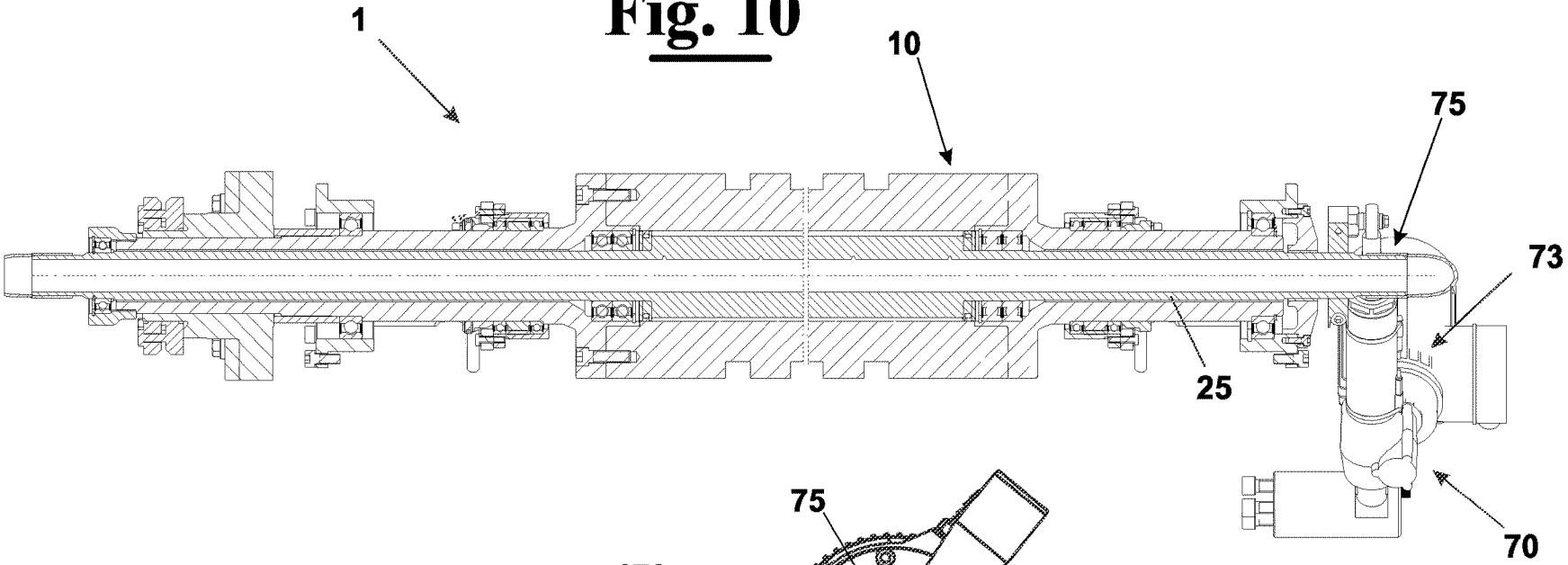
FIG. 10 diagrammatically shows a longitudinal cross section view of an alternative embodiment according to the invention for the suction roll of FIG. 1.

More in particular, as diagrammatically shown in FIG. 10, the aforementioned displacement device 70 can be arranged to engage the fixed tubular body 25 at least at one actuation portion 75, advantageously a portion which axially protrudes from an end of the tubular body 10.

In particular, if the aim is to anticipate the releasing instant tr with respect to the reference condition tr* (broken line in FIG. 6), for example because the machine 100 is operated at an advancement speed of the paper higher than the reference speed, in particular to increase the productivity, or to work a type of paper with a paper weight s less than a reference paper weight s*, the displacement device 70 can be arranged to rotate the fixed tubular body 25 in the sense opposite to the predetermined sense of rotation 110 of the tubular body 10. In this way, in fact, as diagrammatically shown in FIG. 6, the releasing point P2 of the sheet or web of paper from surface 11 of the tubular body 10, is moved upstream of the reference releasing point P2* going in the sense of rotation 110.

Instead, if the aim is to operate the machine at a speed slower than the reference speed v*, or to work a type of paper with a paper weight higher than the reference paper weight s*, the displacement device 70 can be arranged to rotate the fixed tubular body 25 about the longitudinal rotation axis 101 in a sense of rotation consistent with the predetermined sense of rotation 110 of the tubular body 10 to postpone the instant tr in which the web or sheet of paper 5 is released with respect to the reference releasing instant tr* (see FIGS. 7 to 9). In this way, in fact, as diagrammatically shown in FIG. 9, the point P2 at which the sheet or web of paper is released from surface 11 of the tubular body 10, is moved downstream of the reference releasing point P2*.

In an alternative embodiment of the invention, the position of point P1 and/or of point P2 changes with the change of the speed of the machine 100, opportunely anticipating or postponing at least one between the two instants ta and tr in which the sheets 5 are respectively held on and released from the external lateral surface 11 of roll 1. In this case, to anticipate, or postpone, the two instants ta, or tr, a predetermined speed v* is not taken into account and is, instead, the main control unit to compute the positions of the points P1 and/or P2 in function of the speed of the machine 100 and to command the displacement device 70 directly, or indirectly, by an operator who gives the command through an interface device, for example a HMI.

Figure 11:
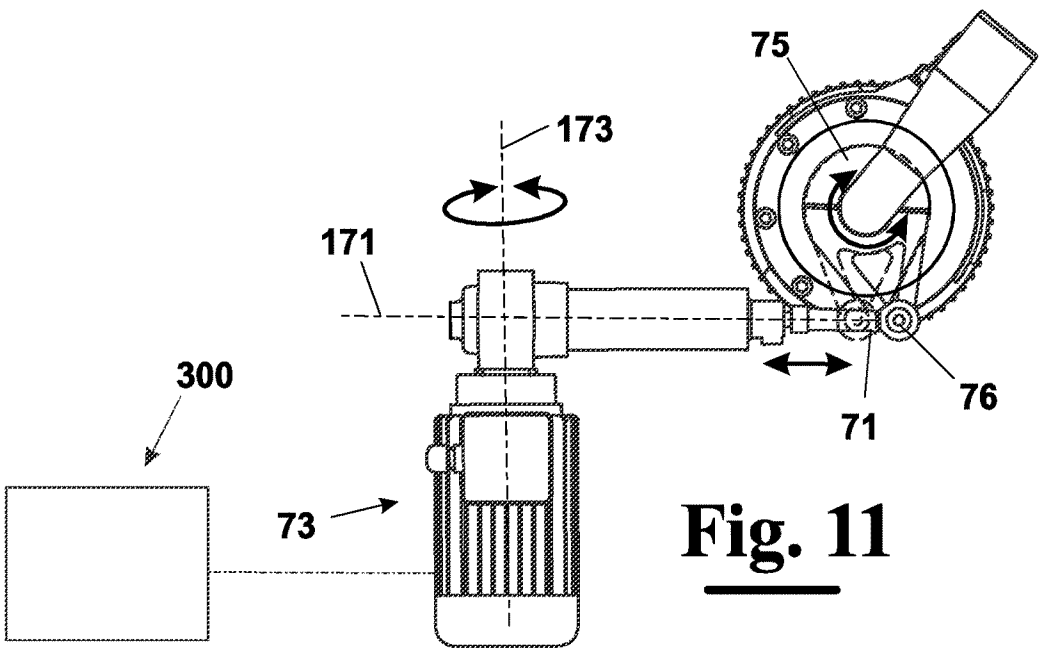
FIG. 11 diagrammatically shows a side elevation view of the alternative embodiment of the suction roll of FIG. 10.

As diagrammatically shown in the FIGS. from 10 to 15, and in particular in FIG. 11, the displacement device 70 can comprise an actuation device 73. In particular, the actuation device 73 can be an actuator, for example a pneumatic actuator, or a mechanical actuator, or an electromechanical actuator. Preferably, the actuation device 73 can be an electric motor provided with a motor shaft (not visible in figure) arranged to rotate about a rotation axis 173. The motor shaft of motor 73 can be arranged to mesh with an worm screw 71 sliding along a sliding direction 171. More precisely, the worm screw 71 is pivotally connected at an engagement portion 76, to an actuation portion 75 integral to said fixed tubular body 25.

Figure 12:
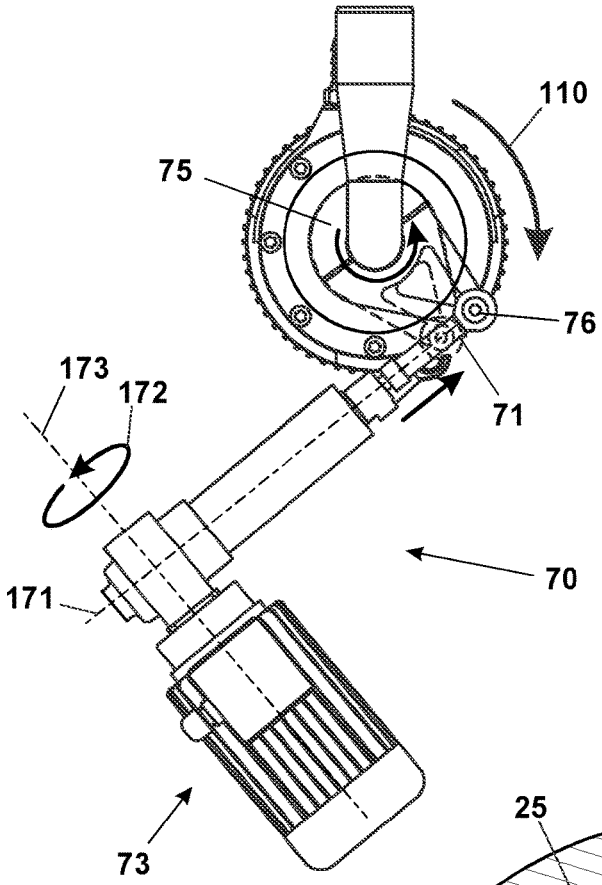
FIGS. 12 and 13 show, respectively, a side view and a transversal cross section of a first functioning mode, respectively, for the left roll and for the right roll of the embodiment of the roll shown in the FIGS. 10 and 11.
Figure 13:
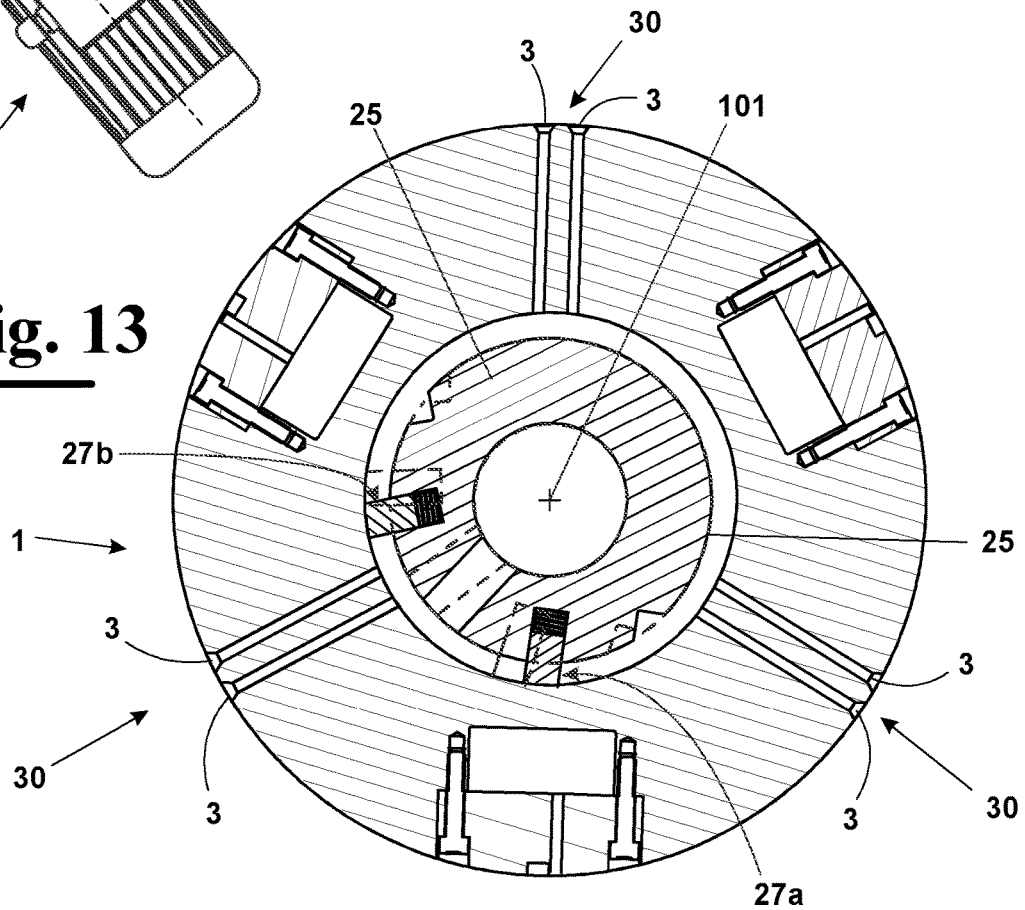

Therefore, to cause a rotation of the fixed tubular body 25 in a first sense, in particular in the sense opposite to the sense of rotation 110 of the tubular body 10, the motor 73 is operated in such a way to cause a rotation of the motor shaft about the rotation axis 173 in a first sense of rotation 172 (see FIG. 12). In this way, as anticipated above, the releasing point P2, in the case of FIG. 13 also the catching point P1, is positioned in an angular position upstream of the angular position of the reference catching point P2*. Therefore, the releasing instant tr is anticipated with respect to the reference case tr* (see also FIG. 6).

Figure 14:
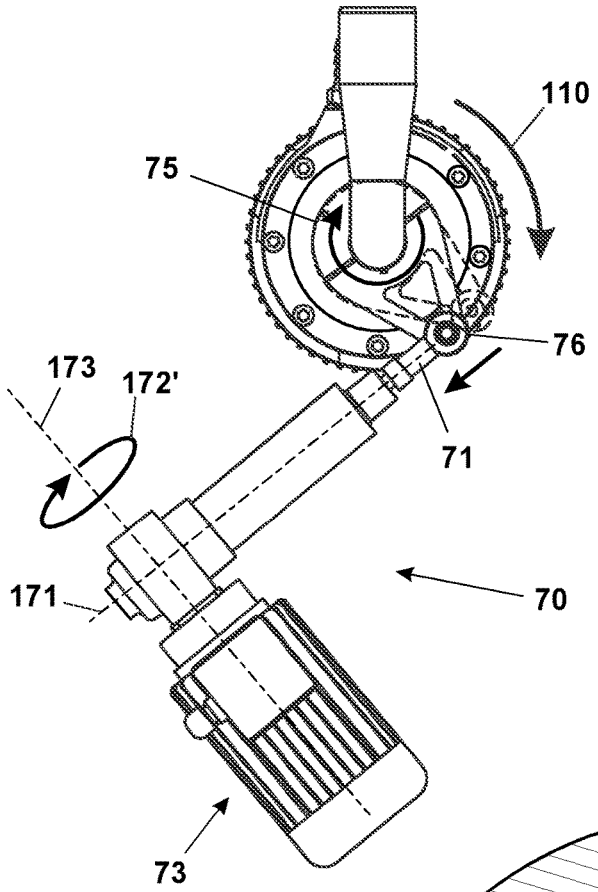
FIGS. 14 and 15 show, respectively, a side view and a transversal cross section of a second functioning mode, respectively, for the left roll and for the right roll of the embodiment of the roll that is shown in the FIGS. 10 and 11.
Figure 15:
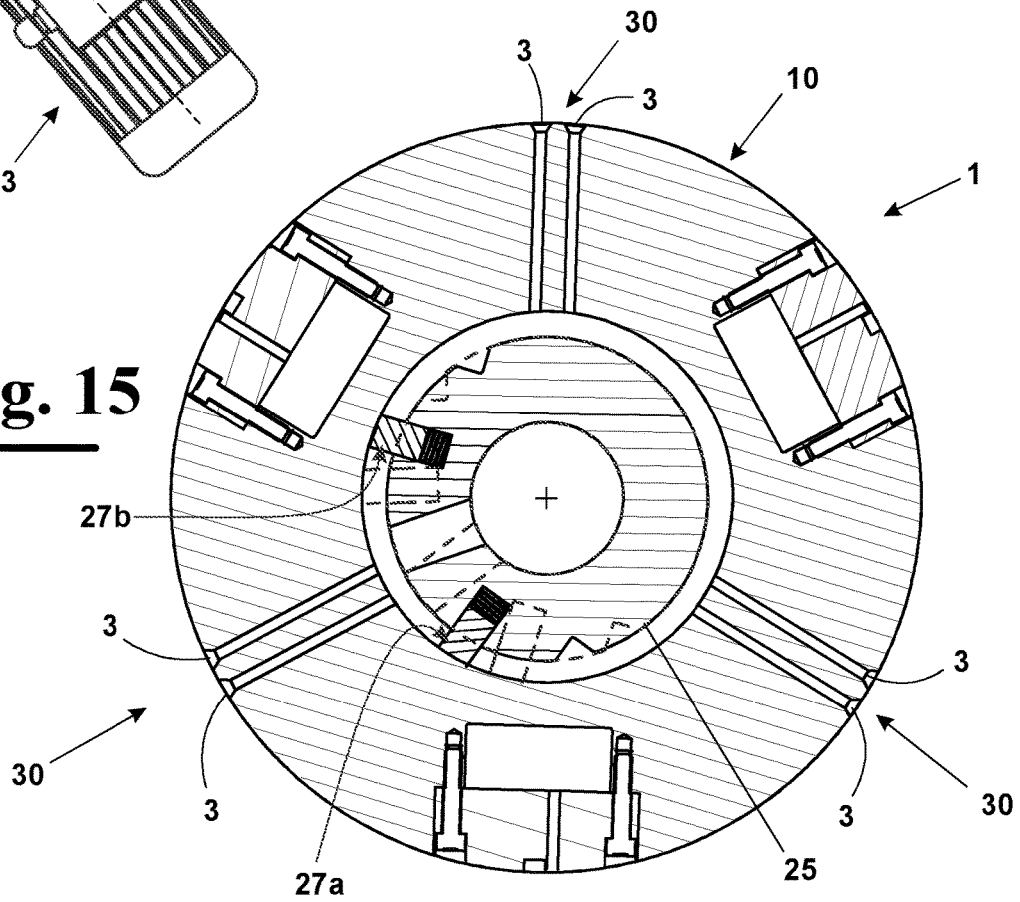

Instead, in order to cause a rotation of the fixed tubular body 25 in a second sense of rotation, in particular in the sense consistent with the sense of rotation 110 of the tubular body 10, the motor 73 is operated in such a way to cause a rotation of the motor shaft about the rotation axis 173 in a second sense of rotation 172' (see FIG. 14). In this way, as anticipated above, the releasing point P2, in the case of FIG. 15 also the catching point P1, is positioned in an angular position downstream of the angular position of the reference catching point P2*. Therefore, the releasing instant tr is postponed with respect to the reference case tr* (see also FIG. 9).

In an alternative embodiment of the invention, the actuation device 73 can be a linear electric actuator i.e. an electric motor whose axis can slide instead of rotating. In this way it is possible to directly connect the electric motor at the engagement portion 76 to the actuation portion 75 integral to said fixed tubular body 25.

In particular, in the embodiments described above and shown in particular in the FIGS. 2, 3, 5, 13 and 15, the suction chamber 20 is pneumatically connected to the suction holes 3 by a vacuum distribution device 50 equipped with the first and second sealing members 27*a* and 27*b* radially oriented and positioned at opposite sides with respect to the, or each, aperture 26. In particular, between the first and second sealing members 27*a* and 27*b* is not present any other element that is able to close the suction holes 3.

Figure 16:
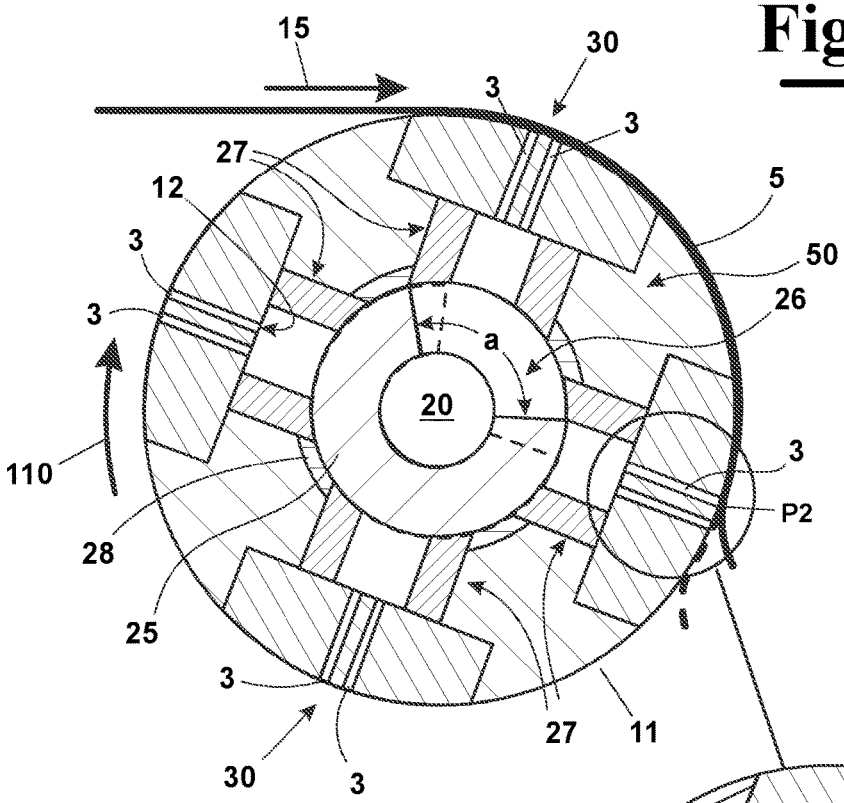
Figure 17:
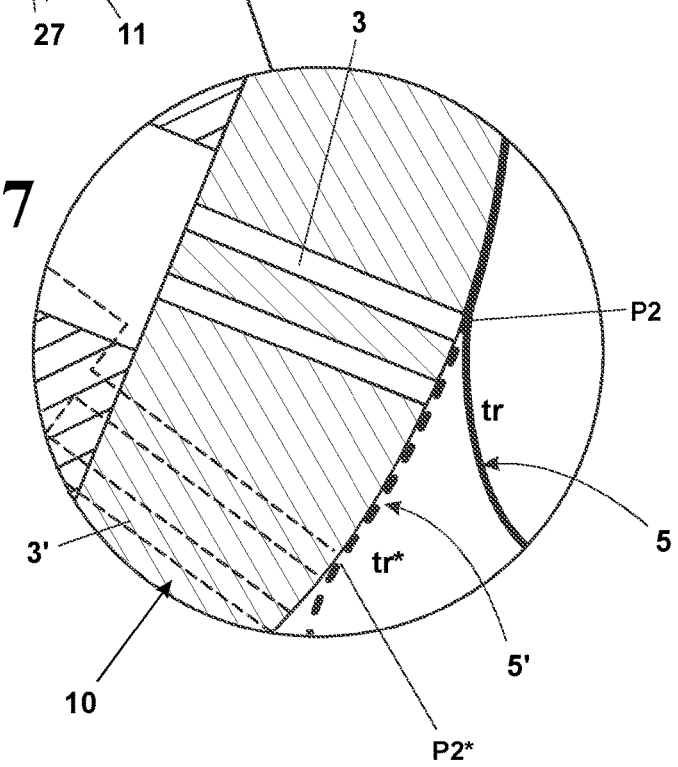
FIG. 17 shows an enlargement of a portion of FIG. 16 in order to highlight some features of the same.

In the alternative embodiment diagrammatically shown in the FIGS. 16 and 17 the aforementioned vacuum distribution device 50 comprises a fixed tubular body 25 coaxially mounted within the tubular body 10 and pneumatically connected to the device for generating a predetermined vacuum degree. More in detail, the fixed tubular body 25 is provided with at least one aperture 26 having a predetermined angular amplitude, in particular substantially corresponding to the length of the panel, i.e. substantially to half the length of the sheet 5 to be processed, or the portion of the path which the web or sheet 5 has to cover on the roll.

The vacuum distribution device 50 comprises in this case a plurality of sealing members 27 integral and positioned longitudinally to the tubular body 10. More in particular, each sealing member 27 is associated to at least one row of suction holes 3 arranged to pneumatically connect the external lateral surface 11 with the device for generating a predetermined vacuum degree through aperture 26. Furthermore, between a sealing member 27 and the following sealing member 27 associated to two different suction groups 30, annular sealing members 28 can be provided. In this case, the displacement device 70 is, advantageously, configured to rotate the fixed tubular body 25 about the longitudinal rotation axis 101. More precisely, as shown, for example in the detail of FIG. 17, to anticipate the releasing instant tr of a sheet or web of paper 5 with respect to the reference condition tr*, the fixed tubular body 25 can be rotated in the sense opposite to the sense of rotation 110 of the tubular body 10. In this way, the releasing point P2 is positioned, moving in the sense of rotation 110, upstream of the angular position of the reference releasing point P2*, because the suction holes 3 leave the web or sheet 5 in advance with respect to the reference case (diagrammatically depicted in figure with a broken line).

In the further alternative embodiment diagrammatically shown in FIG. 18, analogously to what is describe above with reference to the embodiments shown in the FIGS. 5, 8, 13 and 15, a first and a second sealing member 27*a* and 27*b* are provided that extent longitudinally to the tubular body 10 between the internal lateral surface 12 and a fixed tubular body 25. In this case, however, at least one sealing member, for example the sealing member 27*b*, is mounted on a support 21 that can move with respect to the fixed tubular body 25, for example within a guide 22 made peripherally to the fixed tubular body 25. In this case, therefore, the displacement device 70 can be configured to move, in particular to rotate about the longitudinal axis 101, the movable support 21.

In this way, it is possible to change only the releasing position P2, whilst the catching position P1 can be a fixed position and coincident with a reference angular position P1*.

Alternatively, a first and a second displacement device 70*a* and 70*b* can be provided, one configured to move the movable support 21 and the other configured to move the tubular body 25. In this way it is, therefore, possible to change the catching point and the releasing point P1 and P2 independently from each other (FIG. 19).

In an alternative embodiment of the invention that is not shown, it is possible to mount the first and the second sealing member 27*a* and 27*b* on two supports, movable independently with respect to each other, to adjust the catching point P1 and/or the releasing point P2 maintaining the fixed tubular body 25 fixed.

The aforementioned suction roll 1 can be used as folding or interfolding roll in a paper converting machine 100.

Figure 20:
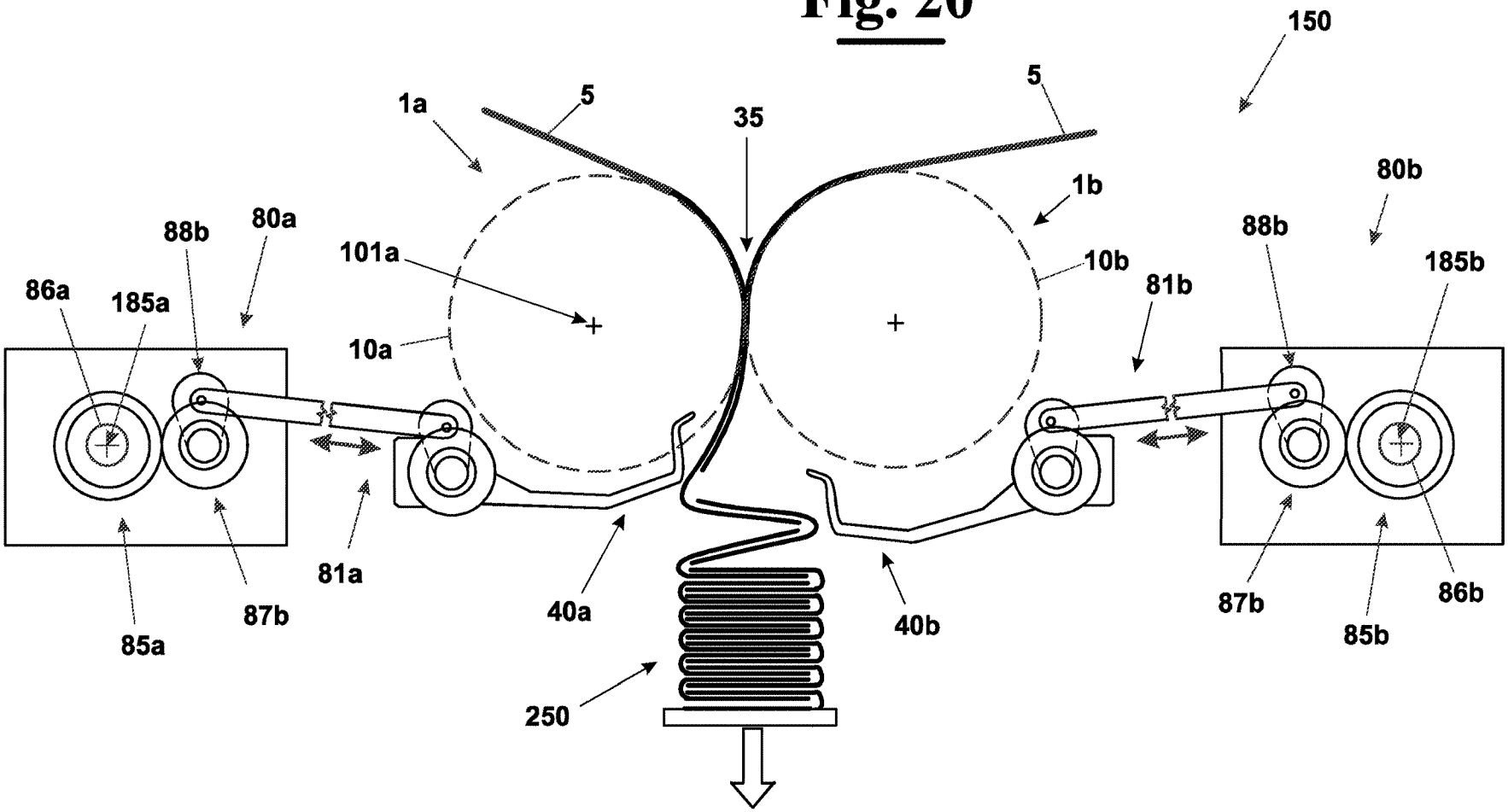

In particular, according to another aspect of the invention, as diagrammatically shown in FIG. 20, a folding or interfolding unit 150 of a machine 100, can comprise a first and a second suction roll 1*a*, and 1*b* as described above with reference to the FIGS. from 1 to 19. In particular, the first and the second suction roll 1*a* and 1*b* are configured to fold or interfold, the web, or sheet, of paper according to a predetermined folding or interfolding configuration, at a folding or interfolding zone 35 defined between them.

In a possible alternative embodiment of the invention, the displacement device 70 comprises a linear, an electric, or electromechanical, or pneumatic, actuator arranged to force the rotation of the vacuum distribution device 50 against a movable abutment member. In this way, changing the position of the movable abutment member, it is possible to adjust the angular position of the vacuum distribution device 50.

Advantageously, in addition to the first and second suction rolls 1*a* and 1*b*, the folding or interfolding unit 150 can comprise a first and a second plurality of detaching fingers 40*a* and 40*b* arranged to operate in phase, respectively, with the first and the second suction roll 1*a* and 1*b* to operate the detachment of a respective web or sheet of paper 5 from the surface 11 of a respective tubular body 10*a* and 10*b*. In particular, a first and a second actuation group 80*a* and 80*b* can be provided configured, respectively, to cause a back-and-forth oscillatory motion of the first and of the second plurality of detaching fingers 40*a*, and 40*b* from/towards the aforementioned folding or interfolding zone 35. In particular, the first and the second actuation group 80*a* and 80*b*, can be, furthermore, configured to delay or anticipate, the oscillatory motion of the first and of the second plurality of detaching fingers 40*a*, and 40*b*, in particular with respect to a predetermined reference oscillatory motion, in such a way to delay or anticipate, the instant tr in which the first and the second plurality of detaching fingers 40*a*, and 40*b* are arranged to cause the detachment of the web or sheet of paper 5 from the respective suction roll 1*a*, and 1*b*, preferably, with respect to a predetermined releasing reference instant tr*.

In particular, in a first embodiment diagrammatically shown in FIG. 20, the first and the second actuation group 80*a*, and 80*b* comprise, respectively a first and a second actuation group 91*a* and 91*b* provided, respectively, with a first and a second motor group 85*a*, 85*b*. These are, advantageously, operatively connected, respectively, to a first and a second motor shaft 86*a* and 86*b*. More precisely, the first and the second motor group 85*a*. 85*b* are arranged to cause a rotation of the first and of the second motor shaft 86*a* and 86*b* about respective axes of rotation 185*a* and 185*b*. The first and the second actuation group 80*a*, and 80*b* can comprise, respectively also a first and a second oscillator device 90*a* and 90*b*, in particular a first and a second mechanical oscillator, configured to convert the rotational motion on the inlet axis to an oscillatory motion on the outlet axis, in particular as a function of a mechanical cam 84*a* and 84*b* provided in the first and the second oscillator device 90*a* and 90*b* provided within the first and with the second oscillator device 90*a* and 90*b*. The oscillator device is known to the skilled person in the art and is not described here in detail. The first and the second motor shaft 86*a* and 86*b* can be connected to the inlet of the first and the second oscillator device 90*a* and 90*b*, whilst the exit shaft is, advantageously, connected to the first and to a second transmission group 81*a*, and 81*b* arranged to transfer the oscillatory motion to said first and second pluralities of detaching fingers 40*a*, 40*b*. In this way, the phase between the detaching fingers 40*a*, 40*b* and the other part of the machine 100 is obtained causing the first and the second motor group 85*a*, 85*b* to rotate at a determined speed. In general, it is possible to use any kinematic mechanism, for example a crank and connecting rod mechanism, to convert the rotational motion of the first and of the second motor group 85*a* and 85*b* to an oscillatory motion of the first and the second transmission group 81*a*, 81*b*. Advantageously, it is possible to adjust the phase of the detaching fingers 40*a*, 40*b*, i.e. to delay or anticipate, the oscillatory motion with respect to the other mechanical organs of the machine 100, slackening, or accelerating, for the necessary time, the first and the second motor group 85*a*, 85*b*. In other words, if the first and the second motor group 85*a*, 85*b* rotate at a reference speed vm*, for an interval of time Δt*, the motors 85*a*, 85*b*, are slacken, or accelerated, and then their speed are brought back to the reference speed vm*. In practice, increasing or decreasing for a determined period of time the speed of rotation, of the first and of the second shaft of rotation 86*a*, 86*b*, with respect to the set speed, the oscillatory motion of the first and of the second plurality of detaching fingers 40*a*, and 40*b* are, respectively, anticipated or postponed.

Figure 21:
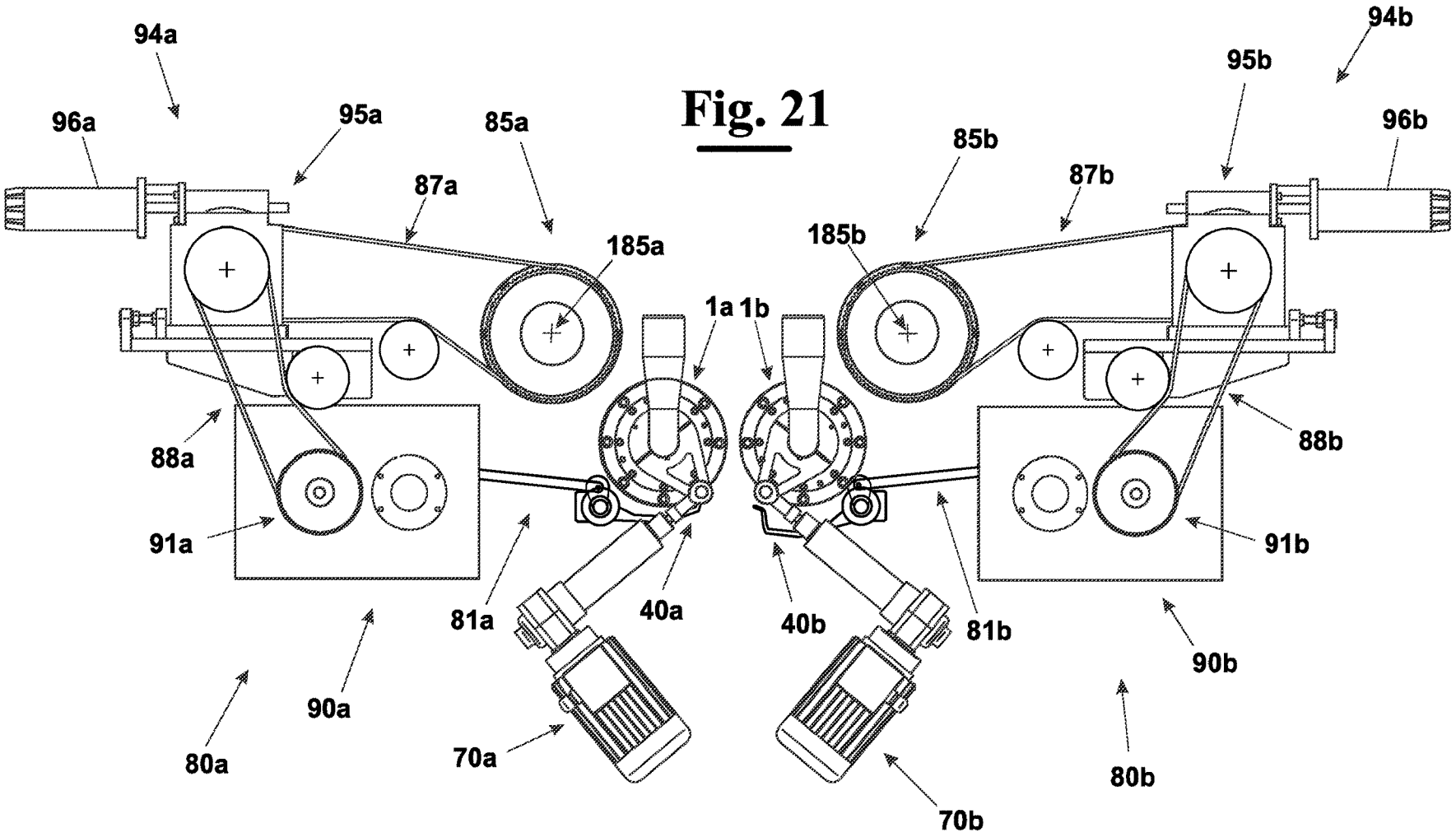

Also in the alternative embodiment diagrammatically shown in FIG. 21, the first and the second actuation group 80*a*, and 80*b* comprise, respectively, a first and a second motor group 85*a*, and 85*b* which are provided with a first and a second motor shaft 86*a*, and 86*b* arranged to rotate about a respective axes of rotation 185*a* and 185*b*. Also in this case a first and a second transmission group 81*a*, and 81*b* are provided arranged to transmit the oscillatory motion produced at the outlet of the first and of the second oscillator device 90*a* and 90*b*, respectively, to the first and to the second plurality of detaching fingers 40*a*, and 40*b*. In this case, however, differently from what stated above with reference to FIG. 20, the first and the second oscillator device 90*a* and 90*b* are, advantageously, associated, respectively, to a first and to a second adjustment device 94*a* and 94*b* configured to adjust the phase of the first and of the second plurality of detaching fingers 40*a* and 40*b* with the respective suction rolls 1*a* and 1*b*. In particular, the first and the second adjustment device 94*a* and 94*b* are arranged to anticipate, or to postpone, the instant tr in which the first and the second plurality of detaching fingers 40*a*, 40*b* are arranged to hit the web or sheet of paper 5 to cause the same to be detached from the respective folding or interfolding roll 1*a* and 1*b*.

Advantageously, the first and the second adjustment device 94*a* and 94*b* comprise, respectively, a first and a second phase-shifter gearbox 95*a*, and 95*b* of type known to the skilled person in the art. More precisely, in this case, the first and the second phase-shifter gearbox 95*a* and 95*b* can be operatively connected, respectively, to the first and second motor group 85*a* and 85*b*, for example by a first transmission belt 87*a*, and 87*b*, and ad a actuation group by a second transmission belt 88*a* and 88*b*. Advantageously, the actuation group comprises a first and a second actuation device 91*a* and 91*b* operatively connected, respectively, to the first and the second phase-shifter gearbox 95*a* and 95*b* by a first and a second transmission belt 87*a* and 87*b*.

More precisely, the first and the second actuation group 91*a* and 91*b* are arranged to transmit the rotational motion to the first and to the second oscillator device 90*ae* 90*b* which convert the rotational motion to the aforementioned oscillatory motion, which is transmitted to the first and to the second plurality of detaching fingers 40*a* and 40*b*. The first and the second phase-shifter gearbox 95*a* and 95*b* are, respectively, provided with a first and a second electric motor 96*a* and 96*b*. These are arranged to adjust the speed of rotation of the first and of the second actuation group 91*a* and 91*b* adjusting the speed and the sense of rotation of a first and a second epicycloidal gear that are housed, respectively, within the first and the second phase-shifter gearbox 95*a* and 95*b*. The first and the second electric motor 96*a* and 96*b* can be normally still in such a way not to change the phase of the detaching fingers 40*a* and 40*b* with respect to the other parts of the machine 100, in particular to the folding rolls 1*a*, 1*b*. In the case that is necessary to change the phase of the detaching fingers 40*a* and 40*b*, the first and second electric motors 96*a* and 96*b* are operated to temporarily accelerate, or decelerate, the second transmission belt 88*a* and 88*b* introducing a delay or an advance to the instant tr in which the first and the second plurality of detaching fingers 40*a*, and 40*b* are arranged to cause the detachment of the web or sheet of paper 5 dal respective suction roll 1*a*, and 1*b*.

Figure 22:
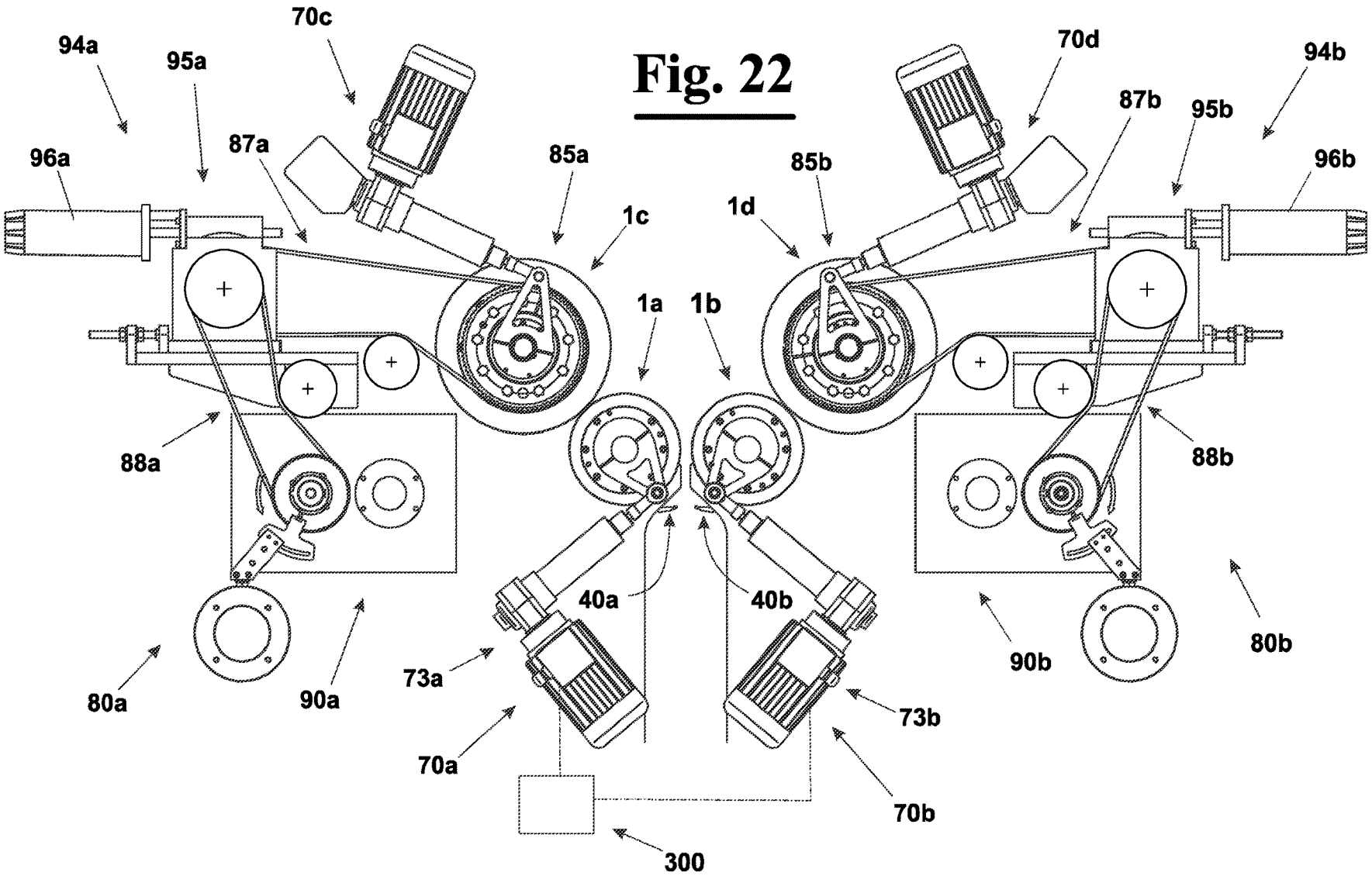

In the further embodiment diagrammatically shown in FIG. 22, downstream of the first and of the second suction roll 1*a* and 1*b* a third and a fourth suction roll 1*c* and 1*d* are provided configured to cut a respective web of paper, respectively, in a predetermined first and second plurality of sheets of predetermined length. According to the present invention, also the third and the fourth suction roll 1*c* and 1*d* can be provided with respective displacement devices 70*c* and 70*d* configured to move, according to one of the embodiments described above with reference to the FIGS. from 1 to 15, a respective vacuum distribution device 50 in such a way to postpone, or anticipate, depending on the aim, the releasing point P2, and, in case, also the catching point P1, of the respective processed web or sheet of paper. In this case, the suction rolls 1*c* and 1*d* are equipped with blades cooperating with counter-blades to carry out a complete cut or a partial cut of the web of paper. The adjustment of the catching point P1 and of the releasing point P2 improves the transfer of the web, or sheet 5, from a roll to another one, for example, as shown in FIG. 22, from suction roll 1*c* to suction roll 1*a* or from suction roll 1*d* to suction roll 1*b*.

The reference values cited above can be computed in different ways. For example, the reference positions P1* and P2* can be those related to a starting position, or point of zero, as known to the skilled person in the art. Alternatively, the reference positions P1* and P2* can be positions referred to a particular condition of the machine, i.e. can be computed considering a machine operating at a determined speed. The reference positions P1* and P2* correspond, respectively, the instants ta* in which the web or sheet of paper 5 adheres to the aforementioned external lateral surface 11 of the suction roll 1, and tr* in which the web or sheet of paper, 5 leaves the aforementioned external lateral surface 11 of the suction roll 1. In practice, it is possible to change, as a function of at least one parameter, the position of points P1 and P2 starting from a starting position, or position of zero, changing as a consequence, the instants ta and tr. The parameters can be the speed of the machine, the paper weight, the type of product to be produced.

In another case, the reference values can be referred to the current state condition of the machine, i.e. it can refer, for example, to the instantaneous operating speed of the machine. In this way, an advance or a delay of the instants ta and tr is referred to the working condition of the machine at the moment in which the change of the phase or of the points P1, P2, or of the detaching fingers 40*a*, 40*b* is carried out.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. A suction roll of a web, or sheet, of paper, fed along an advancing direction in a paper converting machine, or similar products, said suction roll comprising:

a tubular body configured to rotate about a longitudinal rotation axis in a predetermined sense of rotation, said tubular body being provided with an external lateral surface and with an internal lateral surface communicating with each other through a plurality of suction holes organized according to a plurality of longitudinal rows;

a suction chamber defined within said suction roll and pneumatically connected to a vacuum generation device configured to generate a predetermined vacuum degree;

a vacuum distribution device configured to selectively put into pneumatic communication said suction chamber with at least one row of suction holes of said plurality, at determined angular positions of said tubular body, and to cause the processed sheet or web of paper to be sucked, and to adhere at a corresponding portion of said external lateral surface of said suction roll arranged between a catching point and a releasing point (P1,P2) having determined angular positions; and a displacement device configured to move said vacuum distribution device in such a way to change the angular position of said catching point and/or of said releasing point of said web or sheet of paper, and, therefore, to anticipate, or postpone, the catching instant and/or the releasing instant) where said web or sheet of paper adheres to, or leaves said external lateral surface of said suction roll;

wherein said displacement device is configured to move said vacuum distribution device during said rotation of said tubular body about said longitudinal rotation axis, in such a way to progressively follow the increase or decrease of the advancement speed of the web or sheet of paper.

2. The suction roll of a web, or sheet, of paper, according to claim 1, wherein:

said vacuum distribution device comprises a fixed tubular body coaxially mounted within said tubular body, said fixed tubular body being pneumatically connected to said device for generating a predetermined vacuum degree and being provided with at least one aperture; and said displacement device is configured to cause a rotation of said fixed tubular body about said longitudinal rotation axis.

3. The suction roll of a web, or sheet, of paper, according to claim 2, wherein said displacement device is arranged to engage said fixed tubular body at least at an engagement portion axially protruding from an end of said tubular body.

4. The suction roll of a web, or sheet, of paper, according to claim 1, wherein said displacement device comprises an actuation device.

5. The suction roll of a web, or sheet, of paper, according to claim 4, wherein said actuation device is an electric actuator, or a pneumatic actuator, or combination thereof.

6. The suction roll of a web, or sheet, of paper, according to claim 4, wherein said actuation device is configured to be operated on the basis of a command given by an operator through an interface panel, or Human Machine Interface.

7. The suction roll of a web, or sheet, of paper, according to claim 3, wherein said actuation device is configured to be operated by an electronic control unit as a function of at least one of the following parameters:

instantaneous operating speed of the suction roll;

length of the sheet; and paper weight.

8. The suction roll of a web, or sheet, of paper, according to claim 7 wherein said electronic control unit is configured to operate said actuation device to cause said vacuum distribution device to move in a continuous or alternating way between at least two predetermined positions.

9. The suction roll of a web, or sheet, of paper, according to claim 2, wherein said vacuum distribution device comprises a first and a second sealing member integral to said fixed tubular body at opposite sides with respect to said, or each, aperture, said first and second sealing members being positioned longitudinally to said tubular body.

10. The suction roll of a web, or sheet, of paper, according to claim 1, wherein said vacuum distribution device further comprises a plurality of sealing members integral and positioned longitudinally to said tubular body, each sealing member of said plurality being associated to at least one row of suction holes arranged to pneumatically connect said external lateral surface with said device for generating a predetermined vacuum degree.

11. The suction roll of a web, or sheet, of paper, according to claim 1, wherein:

said vacuum distribution device comprises a plurality of sealing members arranged longitudinally to said tubular body, said plurality of sealing members being positioned on at least one movable support configured to move with respect to said tubular body and to said fixed tubular body; and said displacement device is configured to cause a rotation of said movable support about said longitudinal rotation axis.

12. The suction roll of a web, or sheet, of paper, according to claim 2, wherein said displacement device is configured to cause a rotation of said fixed tubular body about said longitudinal rotation axis:

in a sense of rotation consistent with said predetermined sense of rotation of said tubular body to postpone said releasing instant of said sheet or web of paper with respect to a reference releasing time, or in the sense opposite to said predetermined sense of rotation of said tubular body to anticipate said releasing instant of said sheet or web of paper with respect to said predetermined reference releasing time.

13. The suction roll of a web, or sheet, of paper, according claim 1 selected from the group consisting of:

an advancement roll configured to cause the web or sheet of paper to move along a predetermined advancing direction in a paper converting machine;

a cut roll configured to cut a web of paper into a plurality of sheets of predetermined length; and a folding or interfolding roll, configured to fold or interfold a web or sheet of paper according to a predetermined folding or interfolding configuration.

14. The suction roll of a web, or sheet, of paper, according to claim 1, wherein said plurality of longitudinal rows of rows of suction holes are organized according to a plurality of suction groups, each suction group of said plurality comprising at least two longitudinal rows of holes close to each other.

15. The suction roll of a web, or sheet, of paper, according to claim 1 wherein:

said plurality of longitudinal rows of rows of suction holes are organized according to a plurality of suction groups, each suction group of said plurality comprising at least three longitudinal rows of holes close to each other; and the distance between two following suction groups of said plurality is equal to the length of the processed sheet.

16. A folding or interfolding unit of a web, or sheet, of paper, comprising:

a first and a second suction roll of a web, or sheet, of paper, according to claim 1, said first and second suction rolls being configured to fold or interfold said web or sheet of paper according to a predetermined folding or interfolding configuration at a folding or interfolding zone arranged between said first and second suction rolls;

a first and a second plurality of detaching fingers configured to cause said web or sheet of paper to be detached from the external lateral surface of the respective suction roll; and a first and a second actuation group configured, respectively, to cause a back-and-forth oscillatory motion of said first and second pluralities of detaching fingers from/towards said folding or interfolding zone, in such a way to cause the detachment of a respective web or sheet of paper, respectively, from said first and second suction roll, wherein said first and second actuation groups comprise, furthermore, a phase adjustment device configured to introduce a delay or an anticipation, in said oscillatory motion, in such a way to delay or anticipate the instant in which said first and second pluralities of detaching fingers are arranged to hit said respective web or sheet of paper to cause the detachment of the same from said respective suction roll.

17. A method for feeding a web or sheet of paper in a paper converting machine comprising the steps of:

sucking a web or sheet of paper, or similar products, on an external lateral surface of a suction roll comprising:

a tubular body configured to rotate about a longitudinal rotation axis in a predetermined sense of rotation, said tubular body being provided with said external lateral surface and with an internal lateral surface pneumatically communicated to each other through a plurality of suction holes organized according to a plurality of longitudinal rows;

a suction chamber defined within said suction roll and pneumatically connected to a vacuum generation device configured to generate a predetermined vacuum degree; and a vacuum distribution device configured to selectively put into pneumatic communication said suction chamber with at least one row of suction holes of said plurality, at determined angular positions of said tubular body, and to cause the processed sheet or web of paper to be sucked, and to adhere at a corresponding portion of said external lateral surface of said suction roll arranged between a catching point and a releasing point having determined angular positions; and moving said vacuum distribution device in such a way to change the angular position of said catching point and/or of said releasing point of said web or sheet of paper and, therefore, to anticipate, or postpone, the catching instant and/or the releasing instant wherein said web or sheet of paper adheres to or leaves, said external lateral surface of said suction roll, wherein moving said vacuum distribution device is performed during said rotation of said tubular body about said longitudinal rotation axis.

* * * * *